US007442495B2

(12) United States Patent
Suzuki

(10) Patent No.: US 7,442,495 B2
(45) Date of Patent: Oct. 28, 2008

(54) PHOTOTHERMOGRAPHIC MATERIAL

(75) Inventor: Keiichi Suzuki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/335,637

(22) Filed: Jan. 20, 2006

(65) Prior Publication Data

US 2006/0160039 A1 Jul. 20, 2006

(30) Foreign Application Priority Data

Jan. 20, 2005 (JP) ..... 2005-013309

(51) Int. Cl.
*G03C 1/76* (2006.01)
*G03C 1/498* (2006.01)

(52) U.S. Cl. ..... 430/523; 430/531; 430/619; 430/631; 430/640; 430/642; 430/960

(58) Field of Classification Search ..... 430/619, 430/523, 531, 640, 631, 960, 642
See application file for complete search history.

(56) References Cited

U.S. PATENT DOCUMENTS 6,132,949 A * 10/2000 Fujita et al. ..... 430/619
2001/0051319 A1* 12/2001 Oya et al. ..... 430/611
2002/0058220 A1* 5/2002 Tsukada et al. ..... 430/620
2002/0142254 A1* 10/2002 Hirabayashi ..... 430/523

* cited by examiner

*Primary Examiner*—Thorl Chea
(74) *Attorney, Agent, or Firm*—Margaret A. Burke; Sheldon J. Moss

(57) ABSTRACT

The invention provides a photothermographic material containing an image forming layer having at least a photosensitive silver halide, a non-photosensitive organic silver salt, a reducing agent, and a binder on at least one side of a support, an outermost layer on the same side of the support as the image forming layer, and a non-photosensitive intermediate layer between the outermost layer and the image forming layer, wherein 50% by weight or more of a binder of the non-photosensitive intermediate layer is formed by a hydrophobic polymer latex, the outermost layer has a mean thickness of from 0.1 μm to 0.45 μm, and the non-photosensitive intermediate layer has a variation coefficient of a thickness distribution of 50% or less based on a mean thickness of the non-photosensitive intermediate layer. A photothermographic material, which exhibits reduced image unevenness and excellent image storage stability, is provided.

18 Claims, No Drawings

PHOTOTHERMOGRAPHIC MATERIAL

CROSS-REFERENCE TO RELATED APPLICATION

This application claims priority under 35 USC 119 from Japanese Patent Application No. 2005-13309, the disclosure of which is incorporated by reference herein.

BACKGROUND OF THE INVENTION

1. Field of the Invention

The present invention relates to a photothermographic material preferably used in the field of films for medical diagnosis, the field of films for graphic arts, or the like.

2. Description of the Related Art

In recent years, in the field of films for medical diagnosis and in the field of films for graphic arts, there has been a strong desire for decreasing the amount of processing liquid waste from the viewpoints of protecting the environment and economy of space. Technology is therefore required for light sensitive photothermographic materials which can be exposed effectively by laser image setters or laser imagers and thermally developed to obtain clear black-toned images of high resolution and sharpness, for use in medical diagnostic applications and for use in photographic technical applications. The light sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Photothermographic materials utilizing organic silver salts have been made known by "Thermally Processed Silver Systems" by D. H. Klosterboer, appearing in "Imaging Processes and Materials", Neblette, 8th edition, edited by J. Sturge, V. Warlworth, and A. Shepp, Chapter 9, pages 279 to 291, 1989. All patents, patent publications, and non-patent literature cited in this specification are hereby expressly incorporated by reference herein. In general, photothermographic materials have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

Japanese Patent Application Laid-Open (JP-A) Nos. 10-10670 and 10-62899 disclose a technique for preparing an image forming layer using a polymer latex as a binder and an aqueous medium. JP-A No. 2002-303953 discloses a technique for using a polymer latex having a specific physical character as a binder to improve manufacturing-related brittleness and image storability under dark storage conditions (fogging during storage) of photothermographic materials. JP-A No. 11-84573 discloses a technique for using a specific polymer latex as a binder for the image forming layer and a surface protective layer to attain low fog and high Dmax. Further, JP-A Nos. 11-119375 and 11-288058 disclose a technique for providing an intermediate layer having a water-soluble polymer or a polymer latex, between an image forming layer and a surface protective layer.

However, photothermographic materials contain all components necessary for forming an image in a film thereof in advance, and unreacted components and reaction products remain in the film after the image is formed. The unreacted components and the reaction products have a big influence on raw stock storability and image storage stability, and the techniques described above have not provided sufficient improvement. Thus, further improvements are demanded.

SUMMARY OF THE INVENTION

An aspect of the invention is to provide a photothermographic material comprising: an image forming layer comprising at least a photosensitive silver halide, a non-photosensitive organic silver salt, a reducing agent, and a binder on at least one side of a support; an outermost layer on the same side of the support as the image forming layer; and a non-photosensitive intermediate layer between the outermost layer and the image forming layer, wherein 50% by weight or more of a binder of the non-photosensitive intermediate layer is formed by a hydrophobic polymer latex; the outermost layer has a mean thickness of from 0.1 μm to 0.45 μm; and the non-photosensitive intermediate layer has a variation coefficient of a thickness distribution of 50% or less based on a mean thickness of the non-photosensitive intermediate layer.

DETAILED DESCRIPTION OF THE INVENTION

An object of the present invention is to provide a photothermographic material in which image unevenness is reduced and image storage stability is excellent.

In a case where the binder of the image forming layer is a polymer latex and the coating solution of the image forming layer contains water as a main solvent, since the coating solution has no setting property (which refers to a property in which fluidity is generated at a temperature greater than or equal to an ordinary temperature but gelling occurs and fluidity is lost when the temperature is reduced), coating unevenness is generated by fluctuation movement of a web, a wind for drying, or the like in the coating step or drying step. For this reason, conventionally, it has been proposed to provide a non-photosensitive layer having a setting property on the image forming layer so that the image forming layer and the non-photosensitive layer are simultaneously coated to form multilayer. In the non-photosensitive layer having such setting property as described above, a hydrophilic polymer derived from animal protein such as gelatin has been used as a binder.

The present inventors have analyzed in detail factors which affect image storage stability and, as a result, found that, in the total binder on the side of the support having thereon the image forming layer, as the mass ratio of the hydrophilic polymer to the hydrophobic polymer latex becomes higher, the image storage stability becomes worse. On the other hand, since the amount of the hydrophobic polymer latex to be applied in the image forming layer is defined in the range where the image forming property and appropriate film characteristics of the image forming layer are maintained, it has become necessary, for the purpose of enhancing the image storage stability, to reduce the amount of the hydrophilic polymer to be applied to the non-photosensitive layer.

However, it has been found that, when the amount of the hydrophilic polymer to be applied in the non-photosensitive layer is reduced, unexpected image unevenness is generated. The present inventors have investigated the cause of the image unevenness and, as a result, found that variation in coating thickness of an underlayer adjacent thereto has an influence. It has also been found that, in a case in which the outermost layer is made to have a hydrophilic polymer as a binder and an underlayer adjacent thereto which is an intermediate layer is formed, by setting a mean thickness of the outermost layer to be from 0.1 μm to 0.45 μm and controlling a variation coefficient of a thickness distribution of the intermediate layer to be within 50% based on a mean thickness of the intermediate layer, the image storage stability is improved and the image unevenness is reduced, whereby the present invention was achieved.

The present invention provides a photothermographic material which exhibits reduced image unevenness and excellent image storage stability.

Hereinafter, the present invention will be described in detail.

The photothermographic material of the present invention comprises: an image forming layer including at least a photosensitive silver halide, a non-photosensitive organic silver salt, a reducing agent, and a binder on at least one side of a support; an outermost layer which is disposed on the same side of the support as the image forming layer; and a non-photosensitive intermediate layer between the outermost layer and the image forming layer, in which 50% by weight or more of a binder of the non-photosensitive intermediate layer is formed by a hydrophobic polymer latex, wherein the outermost layer has a mean thickness of from 0.1 μm to 0.45 μm, and the non-photosensitive intermediate layer has a variation coefficient of a thickness distribution of 50% or less based on a mean thickness of the non-photosensitive intermediate layer.

Preferably, 50% by weight or more of a binder of the outermost layer is formed by a hydrophilic polymer, and more preferably, gelatin. Preferably, the outermost layer contains a dispersion of a lubricant.

Preferably, 50% by weight or more of the binder of the image forming layer is formed by a hydrophobic polymer latex and 50% by weight or more of the binder of the non-photosensitive intermediate layer is also formed by a hydrophobic polymer latex.

Preferably, the non-photosensitive intermediate layer contains a viscosity increasing agent, and more preferably, a compound selected from at least one of polyvinyl alcohols and cellulose derivatives is contained as the viscosity increasing agent. Further, the non-photosensitive intermediate layer preferably contains an aggregation stabilizer.

Preferably, the hydrophobic polymer latex in the binder of the non-photosensitive intermediate layer is a polymer latex containing a monomer component represented by formula (M) described below in a range of from 10% by weight to 70% by weight.

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group.

Preferably, both of $R^{01}$ and $R^{02}$ in the above formula (M) represent a hydrogen atom, or one of $R^{01}$ and $R^{02}$ represents a hydrogen atom and the other represents a methyl group.

(Non-Photosensitive Intermediate Layer)

The non-photosensitive intermediate layer according to the present invention is disposed between the image forming layer and the outermost layer, and contains a binder having a film-forming property. Besides the binder, the non-photosensitive intermediate layer may contain various additives such as a reducing agent, a development accelerator, a development retarding agent, a dye, a pigment, a plasticizer, a lubricant, a crosslinking agent, a surfactant, or the like, which are described below. The non-photosensitive intermediate layer according to the present invention may be a single layer, or plural layers.

A mean thickness of the non-photosensitive intermediate layer of the present invention is preferably in a range of from 0.1 μm to 10 μm, more preferably from 0.3 μm to 7 μm, and even more preferably from 0.5 μm to 5 μm. A variation coefficient of a thickness distribution of the non-photosensitive intermediate layer of the present invention, in which 50% by weight or more of the binder thereof is formed a hydrophobic polymer latex (hereinafter, abbreviated to a hydrophobic intermediate layer), is 50% or less, preferably 30% or less, and more preferably 10% or less, based on the mean thickness.

In the case where the non-photosensitive intermediate layer, in which 50% by weight or more of the binder is formed by a hydrophobic polymer latex, is composed of plural layers, the mean thickness and the variation coefficient mentioned above are connected to a layer disposed nearest to the image forming layer.

In the present invention, when the variation coefficient of the thickness distribution of the hydrophobic intermediate layer described above exceeds the above range, problem such as density unevenness occurs on the image, and it is not preferred.

In the practice of the present invention, in order to make the variation coefficient of the thickness distribution of the intermediate layer to be 50% or less, various means can be employed, including a control of viscosity by utilizing a viscosity increasing agent described below, an improvement in stability of a coating solution for the intermediate layer by utilizing an aggregation stabilizer, an adjustment of pH of the coating solution for the intermediate layer, the selection of the polymer latex used, the kind of the hydrophilic polymer mixed therewith, and the combining ratio thereof.

The amount of the binder in the non-photosensitive intermediate layer of the present invention is preferably in a range of from 0.1 $g/m^2$ to 10 $g/m^2$, more preferably from 0.3 $g/m^2$ to 0.7 $g/m^2$, and even more preferably from 0.5 $g/m^2$ to 5 $g/m^2$ per one layer.

In the case where the non-photosensitive intermediate layer of the present invention consists of plural layers, the sum of the coating amount of the binders, therefore, the sum for the plural intermediate layers, is preferably in a range of from 0.1 $g/m^2$ to 10 $g/m^2$.

1) Binder for Intermediate Layer

In the present invention, the binder of at least one layer of the non-photosensitive intermediate layers contains an aqueous dispersion of hydrophobic polymer in an amount of 50% by weight or more, preferably in a range of from 80% by weight to 100% by weight, and more preferably from 80% by weight to 90% by weight. When the amount is less than 50% by weight, the effect of improving image storability becomes reduced and it is not preferred.

In the present invention, the aqueous dispersion of hydrophobic polymer may be a latex in which water-insoluble fine particles of hydrophobic polymer are dispersed in an aqueous solvent or such in which polymer molecules are dispersed in molecular states or by forming micelles, but preferred are latex-dispersed particles.

A mean particle size of the dispersed particles is in a range of from 1 nm to 50000 nm, preferably from 5 nm to 1000 nm, more preferably from 10 nm to 500 nm, and even more preferably from 50 nm to 200 nm. There is no particular limitation concerning particle size distribution of the dispersed particles, and they may be widely distributed or may exhibit a monodisperse particle size distribution. From the viewpoint of controlling the physical properties of the coating solution, preferred mode of usage includes mixing two or more types of particles each having monodisperse particle distribution.

There is no particular limitation concerning the hydrophobic binder, but hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like can be preferably used. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, and preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

The glass transition temperature (Tg) of the hydrophobic polymer of the present invention is preferably in a range of from −30° C. to 70° C., more preferably from −10° C. to 35° C. and, most preferably from 0° C. to 35° C. In a case where Tg is lower than −30° C., film-forming property is excellent, but the formed film is poor in heat resistant strength. In a case where Tg is higher than 70° C., heat resistant strength is excellent, but film-forming property is not enough to perform film coating. However, it is possible to use two or more polymers to make Tg fall in the above range. Namely, even if a polymer has a Tg outside the above range, it is preferred that the weight-average Tg thereof is in the range mentioned above.

The I/O value of the hydrophobic polymer is preferably in a range of from 0.025 to 0.5, and more preferably from 0.05 to 0.3. The I/O value used herein means a value of an inorganic value divided by an organic value based on an organic conceptual diagram. In a case where the I/O value is smaller than 0.025, hydrophilicity with respect to the aqueous solvent is so poor that it becomes difficult to perform coating using an aqueous coating solution. In a case where the value is bigger than 0.5, the formed film is so hydrophilic that the film may give unfavorable effects on photographic performance against moisture, photographic properties are extremely deteriorated, and therefore it is not preferred. The I/O value can be calculated by a method described in "Yuuki Gainen Zu—Kiso To Oyo— (Organic Conceptual Diagram—Fundamentals and Applications—)", written by Yoshio Kohda, published by Sankyo Shuppan (1984).

Here, the organic conceptual diagram is to indicate the entire organic compounds at each position on the orthogonal coordinate whose axes indicate, respectively, the organic axis and the inorganic axis, where the characteristics of the compounds are categorized into an organic value representing a covalent bond tendency and an inorganic value representing an ionic bond tendency. The inorganic value based on this diagram is determined with respect to inorganic property or the magnitude of affecting force to the boiling point by various substituents on a basis of hydroxy group, and is a value in which an affecting force per hydroxy group is defined taken as 100 in numerical, since it is about 100° C. when a distance between the boiling point curve of a straight chain alcohol and the boiling point curve of a straight chain paraffin is taken around a carbon atom number of five. In a meantime, the organic value is determined based on that the number of carbon atoms representing the methylene group where each methylene group in the molecule is treated as a unit can measure the magnitude of the number of the organic value. The organic value is set with a standard in which a single piece number of the carbon atom number as the basis is determined as 20 from the average boiling point increase of 20° C. caused by one carbon atom addition to the straight chain compound having around 5 to 10 carbon atoms. The inorganic value and the organic value are set to correspond one to one on the graph. The I/O value is calculated from those values.

More preferable as the binder of the non-photosensitive intermediate layer according to the present invention is a polymer which is obtained by copolymerizing the monomer component represented by formula (M).

In the binder of the non-photosensitive intermediate layer, the content of the polymer which is obtained by copolymerizing the monomer component represented by formula (M) is preferably 80% by weight or higher, more preferably in a range of from 85% by weight to 100% by weight, and even more preferably from 90% by weight to 100% by weight.

$$CH_2{=}CR^{01}{-}CR^{02}{=}CH_2 \qquad \text{Formula (M)}$$

In the formula, $R^{01}$ and $R^{02}$ each independently represent one selected from a hydrogen atom, an alkyl group having 1 to 6 carbon atoms, a halogen atom, or a cyano group.

As an alkyl group for $R^{01}$ or $R^{02}$, an alkyl group having 1 to 4 carbon atoms is preferred, and more preferred is an alkyl group having one or two carbon atoms. As a halogen atom for $R^{01}$ or $R^{02}$, a fluorine atom, a chlorine atom, and a bromine atom are preferred, and more preferred is a chlorine atom.

Particularly preferably, both of $R^{01}$ and $R^{02}$ represent a hydrogen atom, or one of $R^{01}$ and $R^{02}$ represents a hydrogen atom and the other represents a methyl group or a chlorine atom, and more preferably both of $R^{01}$ and $R^{02}$ represent a hydrogen atom, or one of $R^{01}$ and $R^{02}$ represents a hydrogen atom and the other represents a methyl group.

Specific examples of the monomer represented by formula (M) of the present invention include 1,3-butadiene, 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

In the invention, the other monomers, which are capable to copolymerize with the monomer represented by formula (M), are not particularly restricted, and any monomers may be preferably used provided that they are polymerizable by usual radical polymerization or ion polymerization.

Concerning the monomer which can be used preferably, it is capable to select the combination independently and freely from the monomer groups (a) to (j) described below.

—Monomer Groups (a) to (j)—

(a) conjugated dienes: 1,3-butadiene, 1,3-pentadiene, 1-phenyl-1,3-butadiene, 1-α-naphthyl-1,3-butadiene, 1-β-naphthyl-1,3-butadiene, 1-bromo-1,3-butadiene, 1-chloro-1,3-butadiene, 1,1,2-trichloro-1,3-butadiene, cyclopentadiene, and the like;

(b) olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, and the like;

(c) α,β-unsaturated carboxylic acid and salts thereof: acrylic acid, methacrylic acid, itaconic acid, maleic acid, sodium acrylate, ammonium methacrylate, potassium itaconate, and the like;

(d) α,β-unsaturated carboxylate esters: alkyl acrylate (for example, methyl acrylate, ethyl acrylate, butyl acrylate, cyclohexyl acrylate, 2-ethylhexyl acrylate, dodecyl acrylate, and the like), substituted alkyl acrylate (for example, 2-chloroethyl acrylate, benzyl acrylate, 2-cyanoethyl acrylate, and the like), alkyl methacrylate (for example, methyl methacrylate, butyl methacrylate, 2-ethylhexyl methacrylate, dodecyl methacrylate, and the like), substituted alkyl methacrylate (for example, 2-hydroxyethyl methacrylate, glycidyl methacrylate, glycerine monomethacrylate, 2-acetoxyethyl methacrylate, tetrahydrofurfulyl methacrylate, 2-methoxyethyl methacrylate, polypropyleneglycol monomethacrylate (addition mole number of polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, 2-isocyanatoethyl methacrylate, and the like), derivatives of unsaturated dicarboxylic acid (for example, monobutyl maleate, dimethyl maleate, monomethyl itaconate, dibutyl itaconate, and the like), and polyfunctional esters (for example, ethyleneglycol diacrylate, ethyleneglycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyclohexane tetramethacrylate, and the like);

(e) amides of β-unsaturated carboxylic acid: for example, acrylamide, methacrylamide, N-methylacrylamide, N,N-dimethylacrylamide, N-methyl-N-hydroxyethyl methacrylamide, N-tert-butyl acrylamide, N-tert-octyl methacrylamide, N-cyclohexyl acrylamide, N-phenyl acrylamide, N-(2-acetoacetoxyethyl)acrylamide, N-acryloyl morpholine, diacetone acrylamide, diamide itaconate, N-methyl maleimide, 2-acrylamide-methylpropanesulfonic acid, methylenebis acrylamide, dimethacryloyl piperazine, and the like;

(f) unsaturated nitriles: acrylonitrile, methacrylonitrile, and the like;

(g) styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, and the like;

(h) vinyl ethers: methylvinyl ether, butylvinyl ether, methoxyethylvinyl ether, and the like;

(i) vinyl esters: vinyl acetate, vinyl propionate, vinyl benzoate, vinyl salicylate, vinyl chloroacetate, and the like; and (j) other polymerizable monomers: N-vinylimidazole, 4-vinylpyridine, N-vinylpyrrolidone, 2-vinyloxazoline, 2-isopropenylozazoline, divinylsulfone, and the like.

Preferable is a copolymer with styrene, acrylic acid, and/or acrylate ester. More preferable is a copolymer containing styrene and acrylic acid as the monomer component since the resulting hydrophobic polymer can be used in the form of an aqueous dispersion having good dispersion stability.

There is no particular restriction concerning the copolymerization ratio of the monomer represented by formula (M) and other monomer, but preferred is the case where the monomer represented by formula (M) is copolymerized within a range of from 10% by weight to 70% by weight, more preferably from 15% by weight to 65% by weight, and even more preferably from 20% by weight to 60% by weight.

Specific examples of preferred hydrophobic polymer are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents a glass transition temperature.

LP-1; latex of -MMA(55)-EA(42)-MAA(3)-(Tg: 39° C., I/O value: 0.636)

LP-2; latex of -MMA(47)-EA(50)-MAA(3)-(Tg: 29° C., I/O value: 0.636)

LP-3; latex of -MMA(17)-EA(80)-MAA(3)-(Tg: −4° C., I/O value: 0.636)

LP-4; latex of -EA(97)-MAA(3)-(Tg: −20° C., I/O value: 0.636)

LP-5; latex of -EA(97)-AA(3)-(Tg: −21° C., I/O value: 0.648)

LP-6; latex of -EA(90)-AA(10)-(Tg: −15° C., I/O value: 0.761)

LP-7; latex of -MMA(50)-2EHA(35)-St(10)-AA(5)-(Tg: 34° C., I/O value: 0.461)

LP-8; latex of -MMA(30)-2EHA(55)-St(10)-AA(5)-(Tg: 3° C., I/O value: 0.398)

LP-9; latex of -MMA(10)-2EHA(75)-St(10)-AA(5)-(Tg: −23° C., I/O value: 0.339)

LP-10; latex of -MMA(60)-BA(36)-AA(4)-(Tg: 29° C., I/O value: 0.581)

LP-11; latex of -MMA(40)-BA(56)-AA(4)-(Tg: −2° C., I/O value: 0.545)

LP-12; latex of -MMA(25)-BA(71)-AA(4)-(Tg: −22° C., I/O value: 0.519)

LP-13; latex of -MMA(42)-BA(56)-AA(2)-(molecular weight: 540,000, Tg: −4° C., I/O value: 0.530)

LP-14; latex of -St(40)-BA(55)-AA(5)-(Tg: −2° C., I/O value: 0.319)

LP-15; latex of -St(25)-BA(70)-AA(5)-(Tg: −21° C., I/O value: 0.377)

LP-16; latex of -MMA(58)-St(8)-BA(32)-AA(2)-(Tg: 34° C., I/O value: 0.515)

LP-17; latex of -MMA(50)-St(8)-BA(35)-HEMA(5)-AA(2)-(Tg: 27° C., I/O value: 0.542)

LP-18; latex of -MMA(42)-St(8)-BA(43)-HEMA(5)-AA(2)-(Tg: 14° C., I/O value: 0.528)

LP-19; latex of -MMA(24)-St(8)-BA(61)-HEMA(5)-AA(2)-(Tg: −12° C., I/O value: 0.498)

LP-20; latex of -MMA(48)-St(8)-BA(27)-HEMA(15)-AA(2)-(Tg: 39° C., I/O value: 0.619)

LP-21; latex of -EA(96)-AA(4)-(Tg: −21° C., I/O value: 0.644)

LP-22; latex of -EA(46)-MA(50)-AA(4)-(Tg: −4° C., I/O value: 0.739)

LP-23; latex of -EA(80)-HEMA(16)-AA(4)-(Tg: −9° C., I/O value: 0.775)

LP-24; latex of -EA(86)-HEMA(10)-AA(4)-(Tg: −13° C., I/O value: 0.733)

LP-25; latex of -St(45)-Bu(52)-MAA(3)-(Tg: −26° C., I/O value: 0.990)

LP-26; latex of -St(55)-Bu(42)-MAA(3)-(Tg: −9° C., I/O value: 0.105)

LP-27; latex of -St(60)-Bu(37)-MAA(3)-(Tg: 1° C., I/O value: 0.109)

LP-28; latex of -St(68)-Bu(29)-MAA(3)-(Tg: 17° C., I/O value: 0.114)

LP-29; latex of -St(75)-Bu(22)-MAA(3)-(Tg: 34° C., I/O value: 0.119)

LP-30; latex of -St(40)-Bu(58)-MAA(2)-(Tg: −8.1° C., I/O value: 0.293)

LP-31; latex of -St(40)-Bu(58)-MAA(2)-(Tg: −7.1° C., I/O value: 0.287)

LP-32; latex of -St(57.2)-Bu(27.7)-MAA(8.7)-HEMA(4.8)-AA(1.6)-(Tg: 37.8° C., I/O value: 0.269)

LP-33; latex of -St(49.6)-Bu(40)-MAA(4)-HEMA(4.8)-AA(1.6)-(Tg: 16.7° C., I/O value: 0.289)

LP-34; latex of -St(80)-2HA(18)-AA(2)-(Tg: 59.7° C., I/O value: 0.148)

LP-35; latex of -St(70)-2EHA(28)-AA(2)-(Tg: 40.9° C., I/O value: 0.164)

LP-36; latex of -St(10)-2EHA(38)-MAA(50)-AA(2)-(Tg: 25.6° C., I/O value: 0.427)

LP-37; latex of -St(10)-2EHA(58)-MAA(30)-AA(2)-(Tg: −3.9° C., I/O value: 0.365)

LP-38; latex of -St(10)-2EHA(78)-MAA(10)-AA(2)-(Tg: −28.1° C., I/O value: 0.308)

LP-39; latex of -St(20)-2EHA(68)-MAA(10)-AA(2)-(Tg: -16.8° C., I/O value: 0.285)

LP-40; latex of -St(30)-2EHA(58)-MAA(10)-AA(2)-(Tg: −4.4° C., I/O value: 0.263)

LP-41; latex of -MAA(45)-BA(52)-IA(3)-(Tg: 4° C., I/O value: 0.560)

LP-42; latex of -St(62)-Bu(35)-MAA(3)-(crosslinking, Tg: 5° C.)

LP-43; latex of -St(68)-Bu(29)-AA(3)-(crosslinking, Tg: 17° C.)

LP-44; latex of -St(71)-Bu(26)-AA(3)-(crosslinking, Tg: 24° C.)

LP-45; latex of -St(70)-Bu(27)-IA(3)-(crosslinking, Tg: 23° C.)

LP-46; latex of -St(75)-Bu(24)-AA(1)-(crosslinking, Tg: 29° C.)

LP-47; latex of -St(60)-Bu(35)-DVB(3)-MAA(2)-(crosslinking, Tg: 6° C.)

LP-48; latex of -St(70)-Bu(25)-DVB(2)-AA(3)-(crosslinking, Tg: 26° C.)

LP-49; latex of -St(70.5)-Bu(26.5)-AA(3)-(crosslinking, Tg: 23° C.)

LP-50; latex of -St(69.5)-Bu(27.5)-AA(3)-(crosslinking, Tg: 20.5° C.)

LP-51; latex of -St(61.3)-Isoprene(35.5)-AA(3)-(crosslinking, Tg: 17° C.)

LP-52; latex of -St(67)-Isoprene(28)-Bu(2)-AA(3)-(crosslinking, Tg: 27° C.)

In the structures above, abbreviations represent monomers as follows. MMA: methyl methacrylate, EA: ethyl acrylate, MA: methyl acrylate, MAA: methacrylic acid, 2EHA: 2-ethylhexyl acrylate, HEMA: hydroxyethyl methacrylate, St: styrene, Bu: butadiene, AA: acrylic acid, DVB: divinyl benzene, and IA: itaconic acid.

The aqueous dispersion of hydrophobic polymer described above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

As the latex of styrene-butadiene copolymer preferably used in the invention, there can be mentioned the above-described LP-42 to LP-50, or commercially available LACSTAR 3307B, LACSTAR 7132C (all manufactured by Dainippon Ink and Chemicals, Inc.), Nipol Lx416 (manufactured by Nippon Zeon Co., Ltd.), and the like.

As the latex of styrene-isoprene copolymer preferably used in the invention, there can be mentioned the above-described LP-51, LP-52, and the like.

The aqueous dispersion of hydrophobic polymer above may be used alone, or may be used by blending two or more of them depending on needs.

As regards the aqueous dispersion of hydrophobic polymer used for the present invention, the composition thereof is not particularly limited, but preferably falls within the range of Tg and I/O value of the present invention.

In the non-photosensitive intermediate layer of the present invention, if necessary, there can be added hydrophilic polymers such as gelatin, poly(vinyl alcohol), methyl cellulose, hydroxypropyl cellulose, carboxymethyl cellulose, or the like.

To control the minimum film-forming temperature of the aqueous dispersion of hydrophobic polymer, an auxiliary film-forming agent may be added. The auxiliary film-forming agent is also called a plasticizer and is the compound (usually an organic solvent) which makes a minimum film-forming temperature of polymer latex decrease and for instance, is described in the above "GOUSEI LATEX NO KAGAKU" (Soichi Muroi, published by Kobunshi Kankokai (1970)). Preferred auxiliary film-forming agents are the following compounds, but the compound usable in the present invention is not limited in the following specific examples.

Z-1; Benzyl alcohol

Z-2; 2,2,4-Trimethylpentanediol-1,3-monoisobutyrate

Z-3; 2-Dimethylaminoethanol

Z-4; Diethylene glycol

The content of the hydrophobic polymer is preferably in a range of from 5% by weight to 50% by weight, and more preferably from 10% by weight to 40% by weight, with respect to the total coating solution for non-photosensitive intermediate layer.

The coating amount of the hydrophobic polymer for the non-photosensitive intermediate layer is preferably in a range of from 0.1 $g/m^2$ to 10 $g/m^2$, more preferably from 0.3 $g/m^2$ to 7 $g/m^2$, and most preferably from 0.5 $g/m^2$ to 5 $g/m^2$.

2) Viscosity Increasing Agent

A viscosity increasing agent is preferably added to a coating solution for forming the non-photosensitive intermediate layer of the present invention. By the addition of the viscosity increasing agent, intermix with the adjacent layer is hardly occurred in the coating step and drying step so that preferable non-photosensitive intermediate layer having the intended composition can be formed.

In the practice of the present invention, a water-soluble polymer or an aqueous polymer dispersion may be preferably employed as the viscosity increasing agent to give coating ability. Both of natural products and synthetic polymers can be preferably used.

Examples of the water-soluble polymer include, as natural products, starches (corn starch, starch, and the like), seaweeds (agar-agar, sodium aliginate, and the like), vegetable adhesive substances (gum arabic and the like), animal proteins (glue, casein, gelatin, alubmen, and the like), fermented adhesive substances (prulan, dextrin, and the like), and the like, as semi-synthetic polymers, starchy substances (soluble starch, carboxy starch, dextran, and the like), celluloses (viscose, methyl cellulose, ethyl cellulose, carboxymethyl cellulose, hydroxyethyl cellulose, hydroxypropyl cellulose, hydroxypropylmethyl cellulose, and the like), and in addition, synthetic polymers (poly(vinyl alcohol), polyacrylamide, poly (vinyl pyrrolidone), poly(ethylene glycol), poly(propyrene glycol), poly(vinyl ether), poly(ethylene imine), poly(styrene sulfonic acid) and copolymers thereof, poly(vinyl sulfonic acid) and copolymers thereof, poly(vinyl sulfanic acid) and copolymers thereof, poly(acrylic acid) and copolymers thereof, acrylic acid and copolymers thereof, maleic acid copolymer, maleic acid monoester copolymer, acryloylmethyl propane sulfonic acid and copolymers thereof, and the like), and the like.

Examples of the aqueous polymer dispersion include an aqueous dispersion of acrylic polymer, an aqueous dispersion of synthetic rubber polymer (for example, styrene-butadiene copolymer), an aqueous dispersion of polyether polymer, an aqueous dispersion of polyurethane polymer, and the like.

In case of utilizing the above polymer latexes as the viscosity increasing agent, a salt content is preferably so small as to prevent degradation of the stability of the polymer latex used. Among the above viscosity increasing agents, preferred viscosity increasing agent used for the present invention is a water-soluble polymer, and more preferably a nonionic polymer.

Specific examples of the water-soluble polymer include poly(vinyl alcohol), polyacrylamide, poly(vinyl pyrrolidone), poly(ethylene glycol), poly(propyrene glycol), poly (vinyl ether), poly(ethylene imine), poly(styrene sulfonic acid) and copolymers thereof, poly(vinyl sulfonic acid) and copolymers thereof, poly(vinyl sulfanic acid) and copolymers thereof, poly(acrylic acid) and copolymers thereof, acrylic acid and copolymers thereof, maleic acid copolymer, maleic acid monoester copolymer, acryloylmethyl propane sulfonic acid and copolymers thereof, carboxymethyl cellulose, hydroxyethyl cellulose, hydroxypropyl cellulose, hydroxypropylmethyl cellulose, alkaline metal salts of carboxymethyl cellulose, carboxymethyl-hydroxyethyl cellulose, and the like. These compounds are described in detail in "Shin Suiyosei Porima No Oyo to Shijo (New water-soluble polymer, its application and market)" edited by Shinzi Nagatomo, published by Shi Emu Shi Sha, Ltd. (1988).

Among these, a water-soluble polymer selected from poly (vinyl alcohol) derivatives and cellulose derivatives is particularly preferred.

The poly(vinyl alcohol) derivative preferably has a number average polymerization ratio of from 200 to 5,000, and more preferably from 1,000 to 4,000. In the case where the number average molecular weight of the poly(vinyl alcohol) derivative is low, it is very difficult to afford a suitable viscosity for the coating solution. Whereas in the case where the number average molecular weight is large, the addition thereof to the coating solution is liable to cause aggregation of solid dispersion and the polymer latex.

The poly(vinyl alcohol) derivative used for the present invention preferably has a saponification ratio of from 80 mol % to 100 mol %. In the case where the saponification ratio is low, the concentration of the aqueous solution used for the coating solution is so low that desired viscosity of the coating solution cannot be attained and also solid dispersion and the polymer latex tend to aggregate upon addition to the coating solution.

The poly(vinyl alcohol) derivative added to the coating solution used for the present invention is preferably in the form of a solution, and particularly preferably in the form of an aqueous solution. The addition in the form of a powder may often cause the so-called undissolved lump state and result in degraded state in the coated surface. The concentration of the aqueous solution is preferably in a range of from 1% by weight to 20% by weight. "The aqueous solution" herein used means that the water concentration is from 70% by weight to 100% by weight, based on the total solvent weight. In the case where the concentration of aqueous solution is low, the viscosity of the coating solution may be not enough possibly to smooth the resulting coated surface.

On the other hand, in the case where the concentration is high, the poly(vinyl alcohol) derivative strongly interacts with the solid dispersion and the polymer latex during coating process possibly to cause an aggregated precipitation. In case of the above coating solution, the so-called comets with nucleus are often seen on the surface of the coated materials. Moreover, because of the relation of solubility of the poly (vinyl alcohol) derivative in water, sometimes solid of the poly(vinyl alcohol) derivative possibly remains in the prepared solution. In the case, the remained solid may cause the degradation in the coated surface state or depress filtration performance during the coating process. In order to remove the remained solid from the prepared solution, filtration before adding to the coating solution is preferred.

Specific examples of the poly(vinyl alcohol) derivative include the ones described below in the explanation of poly (vinyl alcohols).

The dissolution temperature of the poly(vinyl alcohol) derivative in an aqueous solution used for the present invention is preferably in a range of from 60° C. to 100° C., and more preferably from 70° C. to 100° C. In the case where the dissolution temperature of the poly(vinyl alcohol) derivative is low, the poly(vinyl alcohol) possibly be remained in the form of a solid in the solution. In this case, the remained poly(vinyl alcohol) derivative may cause to deteriorate the surface state of the coating surface or depress filtration performance during the coating process. Whereas in the case where the dissolution temperature is so high such as over 100° C., special devices such as a high-pressure steam vessel or the like are required, depending on the solvent constituent of the solution, for preparing the aqueous solution used for the present invention because the boiling point of water is 100° C. The above is not preferred because the production cost for making the aqueous solution may be raised.

Viscosity of the poly(vinyl alcohol) derivative is preferably in a range of from 150 cP to 250 cP at 25° C. and a concentration of 5% by weight.

The addition amount of the water-soluble polymer as the viscosity increasing agent is not limited as far as viscosity is raised to the suitable range on adding to the coating solution. Generally, the concentration of the water-soluble polymer in the solution is in a range of from 0.01% by weight to 30% by weight, preferably from 0.05% by weight to 20% by weight, and more preferably from 0.1% by weight to 10% by weight. Viscosity obtained by the above addition is preferably in a range of from 1 cP to 200 cP, and more preferably from 5 cP to 100 cP, based on the increase from the initial viscosity. The viscosity measurement is performed by using B-type rotary viscometer at 25° C. On addition of the viscosity increasing agent to the coating solution, generally, the solution diluted as possible is preferred and thorough stirring during the addition is preferred.

3) Aggregation Stabilizer

The coating solution for the non-photosensitive intermediate layer of the present invention contains an aggregation stabilizer. The aggregation stabilizer used herein means a compound which can lower the viscosity value obtained by adding the viscosity increasing agent into polymer latex solution by utilizing the aggregation stabilizer.

By the addition of the aggregation stabilizer in combination with the viscosity increasing agent, aggregate formation caused by the degraded stability of the polymer latex on the interface to the adjacent layer is hardly occurred in the coating step and drying step so that preferable intermediate layer having the intended composition can be formed.

The working mechanism thereof has not been cleared, but it is supposed that the aggregation stabilizer adsorbed on the polymer latex particle surface prevents aggregation of the latex particles themselves and controls the crosslinking reaction of the polymer latex particles by the viscosity increasing agent at a suitable level.

Examples of the preferred aggregation stabilizer include a amphoteric surfactant, a nonionic surfactant, and a modified poly(vinyl alcohol). The preferred nonionic surfactant is ethylene oxide-propylene oxide copolymer.

<Amphoteric Surfactant>

The amphoteric surfactant used herein means a surfactant containing an anionic active atomic group and a cationic active atomic group in the molecule. Accordingly, the amphoteric surfactant comprises a chemical linkage between an anionic (hydrophilic) atomic group, a cationic (hydrophilic) atomic group, and a hydrophobic atomic group. As the anionic atomic group of the amphoteric surfactant, carboxylic acid, sulfate ester, sulfonic acid, alkylaryl sulfonate, phosphate ester, and alkyl phosphonic acid are generally used.

As the anionic atomic group of the amphoteric surfactant used for the present invention, carboxylic acid is particularly preferred.

As the cationic atomic group of the surfactant, various amines (including tertiary ammonium, imines, amizines, and guanidines) are empolyed. The hydrophobic atomic group is generally a hydrocarbon group. As the hydrocarbon group, an aliphatic group is more preferred than an aromatic group. Particularly preferred amphoteric surfactants are shown in the following formula (WI).

Formula (WI)

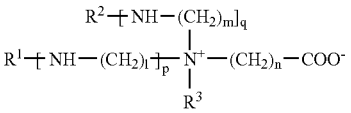

In formula (WI), $R^1$ represents a hydrocarbon group having 5 to 22 carbon atom. $R^1$ constitutes a hydrophobic atomic group. Examples of the hydrocarbon group include an alkyl group, an alkenyl group, an alkynyl group, an aryl group, and an aralkyl group. Preferable are an alkyl group and an alkenyl group, and more preferable is an alkyl group. The alkyl part of the alkyl group, alkenyl group, alkynyl group, and aralkyl group may be linear, branched or cyclic formed. The aryl group may be substituted by an alkyl group, an alkenyl group, an alkynyl group, or an aralkyl group. $R^1$ has preferably from 8 to 20 carbon atoms. l represents 1 or 2. p represents 0, 1, 2, or 3. p may be 0, namely, the linking group equivalent to $[NH—(CH_2)_l]$ may be excluded.

$R^2$ represents a hydrogen atom or a hydrocarbon group having 1 to 22 carbon atoms. The definition of the hydrocarbon group is similar to the above $R^1$. m represents 1 or 2. q represents 0, 1, 2, or 3. q may be 0, namely, the linking group equivalent to $[NH—(CH_2)_m]$ may be excluded. $R^3$ represents a hydrogen atom or a methyl group. n represents 1 or 2.

The amphoteric surfactants described above are well known in the art and can be available as commercial products, for example, used for detergents, emulsifying agents, dispersing agents, humid permeaters, antistatic agents, and the like. Specific examples of the amphoteric surfactant are shown below, but the invention is not limited to these examples.

(WI-1)

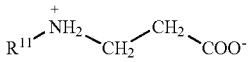

($R^{11}$ is alkyl having 6 to 20 carbon atoms or alkenyl having 16 to 18 carbon atoms.)

(LIPOMIN LA (manufactured by Lion Corp.))

(WI-2)

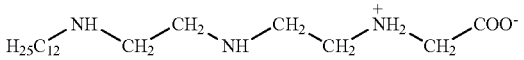

(NISSANANON LG (manufactured by NOF Corp.))

(WI-3)

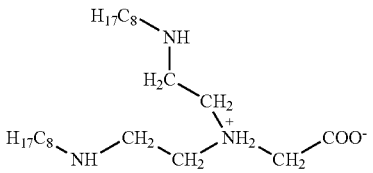

(OBANOL 516 (manufactured by Toho Chemical Industry Co., Ltd.))

(WI-4)

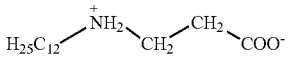

(PIONIN C-158 (manufactured by Takemoto Oil & Fat Co., Ltd.))

(WI-5)

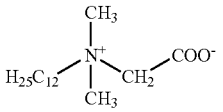

(ANHITOL 24B (manufactured by kao Corp.))

(WI-6)

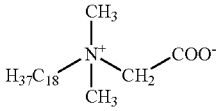

(ANHITOL 86B (manufactured by Kao Corp.))

(WI-7)

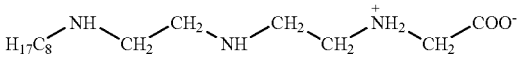

(PIONIN C-156 (manufactured by Takemoto Oil & Fat Co., Ltd.))

Other than the above compounds, N-dodecyl amino ethyl glycine, N-octylamino proponic acid, N-stearyl amino acetic acid, N-(γ-+decyloxy propyl)-β-imino dipropionic acid, N-hexadecyl-N,N'-dimethyl amino glycine, β-(2-octadecyl-4-methyl oxazolin-4-yl)-methoxy propionic acid, 3,3'-{[2-(2-decyl imidazolin-1-yl)ethyl]-imino-}diacetic acid, α-(1-oxyethyl-2-octyimidazoline-1-yl)acetic acid, β-(N-nonadecyl amino)ethyl sulfonic acid, N-amino-coconut-alkyl sulfonic acid, N-harden cow fat alkylamino acetic acid, dodecylimino bis-(2-oxypropane-3-sulfonic acid), β-(2-iso-hexanoyl ethylamino)ethyl sulfuric acid, N-tetradecylimino bis-(2-ethyl sulfuric acid), β-(2-hexadecyl imidazolin-1-yl)-ethyl sulfuric acid, α-(N-octylamino)ethyl sulfonic acid, octyl polyamino ethyl glycine hydrochloride, dodecyl diaminoethyl glycine sodium salt, N-dodecyl diaminoethyl glycine hydrochloride, and N-tetradecyl tauric acid are described.

The addition amount of the amphoteric surfactant is preferably in a range of from 0.01% by weight to 15% by weight, and more preferably from 0.1% by weight to 10% by weight, based on the solution. When the addition amount is less than 0.01% by weight, the effect thereof becomes insufficient.

<Nonionic Surfactant>

Among the nonionic surfactants, preferably used for the present invention is polyether, for example, generally, a condensed product of ethylene oxide and propylene oxide, namely, a copolymer of ethylene oxide and propylene oxide with a linear or branched alkyl-, alkylaryl-, alkenyl alcohol having 2 to 18 carbon atoms, for example, a nonionic surfactant Tergitol X series (trade name, available from Union Carbide Co., Ltd.), and a block copolymer of ethylene oxide and propylene oxide, for example, Pluronic and Tetronic emulsifying agent (trade name, available from BASF Co., Ltd.).

Other preferred nonionic emulsifying agents are compounds such as so-called "Tween or Span" (trade name, available from ICI Inc.) which are named for polyalkylene derivatives and aliphatic acid esters of sorbitan. Specific examples of the nonionic emulsifying agent include ethoxylic aliphatic alcohol, ethoxylic alkyl phenol, ethoxylic aliphatic acid, ethoxylic aliphatic ester, sorbitan derivatives, sucrose ester and derivatives thereof, ethylene oxide-propylene oxide block copolymer, fluorinated alkyl polyoxyethylene ethanol, and mixtures thereof, but are not limited to these examples. Example of the other useful nonionic emulsifying agent is IGEPAL CA-897 (trade name, available from Rhone-Poulenc SA) which is octyl phenoxy polyoxyethylene ethanol. The nonionic emulsifying agent is used in an amount of from about 2% by weight to about 10% by weight, more preferably from about 3% by weight to about 5% by weight, and most preferably in an amount of about 4% by weight, based on the total weight of the free group polymerizing monomer, the emulsifying agent, and the polymerization initiator.

Examples of the polyoxyalkylene ether nonionic surfactant include polyoxyalkylene alkylether, polyoxyalkylene alkylphenyl ether, polyoxyalkylene polyol alkyl ether, polyoxyalkylene styrene-substituted phenol ether, polyoxyalkylene tristyrene-substituted phenol ether, and the like.

Examples of the polyol described above include a polyalcohol having 2 to 12 carbon atoms such as polypropyrene glycol, glycerine, sorbitol, glucose, sucrose, pentaerthritol, sorbitan, and the like.

Examples of the polyoxyalkylene ester nonionic surfactant include polyoxyalkylene aliphatic acid ester and the like. Examples of the poly-alcohol aliphatic ester nonionic surfactant include aliphatic acid ester of poly-alcohol having 2 to 12 carbon atoms and aliphatic acid ester of polyoxyalkylene poly-alcohol. More specifically, examples include sorbitol aliphatic acid ester, sorbitan aliphatic acid ester, aliphatic acid monoglyceride, aliphatic acid diglyceride, polyglycerine aliphatic acid ester, and the like. The polyalkylene oxide addition product thereof (for example, polyoxyalkylene sorbtan aliphatic acid ester, polyoxyalkylene glycerine aliphatic acid ester, and the like) can also be employed.

Examples of the sugar aliphatic acid ester nonionic surfactant include cane sugar, glucose, maltose, furactose, aliphatic acid ester of polysaccharides and their polyalkylene oxide addition products. Examples of the alkyl polyglucoside nonionic surfactant include alkyl glucoside, alkyl polyglucoside, polyoxyalkylene alkylglucoside, polyoxyalkylene alkylpolyglucoside and their aliphatic esters. And their polyalkylene oxide addition products can also be employed.

Examples of the alkyl group of the surfactants described above include an alkyl group having 4 to 30 carbon atoms. And examples of the polyoxyalkylene group include an alkylene group having 2 to 4 carbon atoms and an addition mol number of ethylene oxide of from 1 mol to 50 mol. Examples of the aliphatic acid include linear or branched, saturated or unsaturated aliphatic acid having 4 to 30 carbon atoms.

The preferred nonionic surfactant used for the present invention is a polyalkylene oxide compound.

<Pluronic>

A polyalkylene oxide compound is explained below. The polyalkylene oxide compound used herein means a compound containing polyalkylene oxide as a partial structure and has a function of a surfactant. As the polyalkylene oxide, preferred is polyethylene oxide and polypropylene oxide.

As the polyalkylene oxide compound, the ethylene oxide-propylene oxide copolymers represented by the following formulae (I) to (IV) of the present invention are preferred. The polyethylene oxide-propylene oxide copolymers represented by the following formulae (I) to (IV) are explained below.

Formula (I)

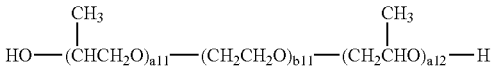

Formula (II)

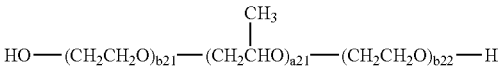

Formula (III)

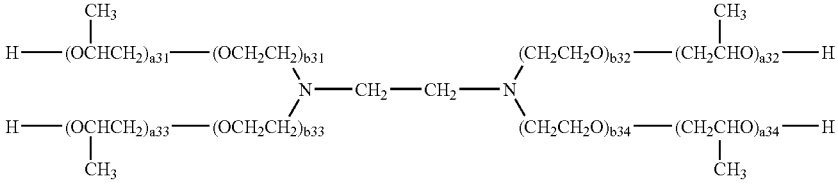

Formula (IV)

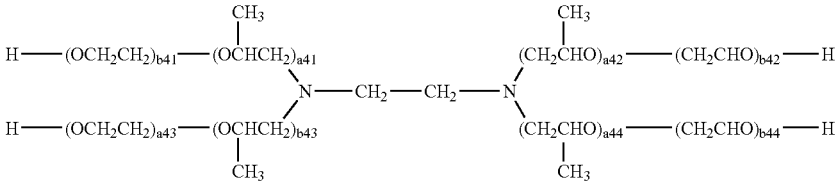

In formulae (I) to (IV), $a_{11}$, $a_{12}$, $b_{11}$, $a_{21}$, $b_{21}$, $b_{22}$, $a_{31}$, $a_{32}$, $a_{33}$, $a_{34}$, $b_{31}$, $b_{32}$, $b_{33}$, $b_{34}$, $a_{41}$, $a_{42}$, $a_{43}$, $a_{44}$, $b_{41}$, $b_{42}$, $b_{43}$, and $b_{44}$ represent an average number of the respective alkyleneoxy groups.

The ratio of the ethyleneoxy group included in the molecule of the compound represented by formula (I) to (IV) is in a range of from 5% by weight to 70% by weight, preferably from 10% by weight to 60% by weight, more preferably from 20% by weight to 50% by weight, and particularly preferably from 25% by weight to 45% by weight. The molecular weight of the propyleneoxy group part is from 500 to 7,000, and preferably from 800 to 6,500. More especially, as for the compound represented by formula (I), the ratio of ethyleneoxy group therein is in a range of from 10% by weight to 80% by weight, preferably from 20% by weight to 70% by weight, more preferably from 30% by weight to 65% by weight, and particularly preferably from 35% by weight to 60% by weight. The molecular weight of propyleneoxy group part is from 1,000 to 6,000, preferably from 1,200 to 5,000, and more preferably from 1,500 to 4,000. As for the compound represented by formula (II), the ratio of ethyleneoxy group is in a range of from 5% by weight to 70% by weight, preferably from 10% by weight to 60% by weight, more preferably from 20% by weight to 50% by weight, and particularly preferably from 25% by weight to 45% by weight. The molecular weight of the propyleneoxy group part is from 1,000 to 4,000, and more preferably from 1,500 to 3,000. As for the compound represented by formula (III), the ratio of ethyleneoxy group is in a range of from 10% by weight to 70% by weight, preferably from 20% by weight to 60% by weight, and more preferably from 30% by weight to 50% by weight. The molecular weight of propyleneoxy group part is from 500 to 7,000, and preferably from 2,000 to 6,000. As for the compound represented by formula (IV), the ratio of ethyleneoxy group is in a range of from 10% by weight to 70% by weight, preferably from 20% by weight to 60% by weight, and more preferably from 30% by weight to 50% by weight. The molecular weight of propyleneoxy group part is from 1,000 to 7,000, and preferably from 2,000 to 6,000.

Accordingly, $a_{11}$ and $a_{12}$ in formula (I) are each independently an integer of from 5 to 60, preferably from 8 to 40, and more preferably from 10 to 30. $a_{11}$ and $a_{12}$ may be the same or different, but $a_{11}$ and $a_{12}$ are preferably the same. $b_{11}$ is an integer of from 3 to 350, preferably from 5 to 200, and more preferably from 10 to 100. In formula (II), $a_{21}$ is an integer of from 10 to 100, preferably from 15 to 80, and more preferably from 20 to 60. $b_{21}$ and $b_{22}$ are each independently an integer of from 2 to 200, preferably from 3 to 150, and more preferably from 5 to 100. $b_{21}$ and $b_{22}$ may be the same or different, but $b_{21}$ and $b_{22}$ are preferably the same. In formula (III), $a_{31}$, $a_{32}$, $a_{33}$, and $a_{34}$ are each independently an integer of from 2 to 100, preferably from 5 to 80, and more preferably from 7 to 50. $b_{31}$, $b_{32}$, $b_{33}$, and $b_{34}$ are each independently an integer of from 2 to 200, preferably from 3 to 100, and more preferably from 5 to 50. In formula (IV), $a_{41}$, $a_{42}$, $a_{43}$, and $a_{44}$ are each independently an integer of from 2 to 100, preferably from 5 to 80, and more preferably from 7 to 50. $b_{41}$, $b_{42}$, $b_{43}$, and $b_{44}$ are each independently an integer of from 2 to 200, preferably from 3 to 100, and more preferably from 5 to 50.

The above number $a_{11}$ to $a_{44}$, and $b_{11}$ to $b_{44}$ usually represent independently an average number which has some distribution range, but the distribution is preferably a narrow range within ±20%, more preferably within ±10%, and particularly preferably within ±5%.

In the case where the ratio of ethyleneoxy group is higher than the above range, the effect of the present invention is remarkably reduced. On the other hand, in the case where the ratio of ethyleneoxy group is too low, the solubility thereof is depressed and then the processing solution tends to be turbid because of exceeding the cloud point. In the case where the molecular weight of the propyleneoxy group part exceeds the above range, the solubility thereof is depressed and then the processing solution tends to be turbid. In the case where the molecular weight of the propyleneoxy group part is low, the effect is lowered. The combined use of two or more of the polyethylene oxide/polypropylene oxide copolymer-type surfactants can be employed and it is preferred from the viewpoint of increasing the solubility.

Specific examples of the polyethylene oxide/polypropylene oxide copolymer-type surfactant represented by formula (I) to (IV) of the present invention are shown in the following Table, which are expressed by the average number of the respective ethyleneoxy group and propyleneoxy group, but the invention is not limited to these examples.

As the polyethylene oxide/polypropylene oxide copolymer-type surfactant preferably used for the present invention, preferable are I-7 to I-13, I-17 to I-20, and II-2 to II-6, and more preferable are I-7 to I-10 and I-17 to I-20.

Among the compounds represented by formula (I) to (IV) of the present invention, preferred are the compounds represented by formula (I) or (II), and more preferred is the compound represented by formula (I).

The compounds represented by formula (I) to formula (IV) as, for example, nonionic surfactant such as Pluronic R, Pluronic, Tetronic R and Tetronic (trade name, available from BASF Co., Ltd.).

Pluronic L-31, L-35, F-38, L-42, L-44, F-68, L-72, P-65, F-77, F-87, F-98, F-108, F-127, P-123, P-103, P-105, and P-84 and Pluronic R series such as 10R8, 10R5, and 12R3 can be employed.

<Alkyl Modified poly(vinyl alcohol)>

The modified poly(vinyl alcohol) usable in the invention preferably has a saponification ratio of from 80% to 99.9% and a polymerization degree of from 100 to 2,400. Copolymer-type modified poly(vinyl alcohol), terminal thiol modified poly(vinyl alcohol), and terminal alkyl modified poly (vinyl alcohol) can be employed, but among these, particularly preferred is alkyl modified poly(vinyl alcohol). With regards to the modification of poly(vinyl alcohol), the detail is described in "Polyvinyl Alcohol-Development", pages 77 to 156, edited by C. A. Finch (John. Wiley & Sons Ltd., 1992). The copolymer modification and chain transfer modification are mainly applied, and particularly preferable is a terminal alkyl modified poly(vinyl alcohol) by the chain transfer modification.

TABLE 1

| Compound No. | Number of PO Group Unit | | | | Number of EO Group Unit | | | | Ratio of EO Group (% by weight) | Molecular Weight of PO Group Part |
|---|---|---|---|---|---|---|---|---|---|---|
| | $a_{11}$ | $a_{12}$ | | | $b_{11}$ | | | | | |
| I-1 | 60 | 60 | | | 10 | | | | 6 | 6960 |
| I-2 | 25 | 25 | | | 7.5 | | | | 10 | 2900 |
| I-3 | 32 | 32 | | | 15 | | | | 15 | 3712 |
| I-4 | 21.3 | 21.3 | | | 14.1 | | | | 20 | 2471 |
| I-5 | 25 | 25 | | | 22 | | | | 25 | 2900 |
| I-6 | 23 | 23 | | | 26 | | | | 30 | 2668 |
| I-7 | 30 | 30 | | | 52 | | | | 40 | 3480 |
| I-8 | 30 | 15 | | | 40 | | | | 40 | 3610 |
| I-9 | 18.6 | 18.6 | | | 32.7 | | | | 40 | 2458 |
| I-10 | 13 | 13 | | | 23 | | | | 40 | 1508 |
| I-11 | 9 | 9 | | | 16 | | | | 40 | 1044 |
| I-12 | 15 | 15 | | | 40 | | | | 50 | 1740 |
| I-13 | 15 | 15 | | | 60 | | | | 60 | 1740 |
| I-14 | 5 | 5 | | | 30 | | | | 69 | 580 |
| I-15 | 50 | 50 | | | 300 | | | | 69 | 5800 |
| I-16 | 15 | 15 | | | 155 | | | | 80 | 1740 |
| I-17 | 30 | 30 | | | 80 | | | | 50 | 3485 |
| I-18 | 26 | 26 | | | 85 | | | | 55 | 3020 |
| I-19 | 25 | 25 | | | 100 | | | | 60 | 2904 |
| I-20 | 30 | 30 | | | 100 | | | | 50 | 3485 |
| | $a_{21}$ | | | | $b_{21}$ | $b_{22}$ | | | | |
| II-1 | 30 | | | | 5 | 5 | | | 20 | 1740 |
| II-2 | 28 | | | | 8 | 8 | | | 30 | 1624 |
| II-3 | 32 | | | | 15 | 15 | | | 42 | 1856 |
| II-4 | 36 | | | | 24 | 24 | | | 50 | 2088 |
| II-5 | 52 | | | | 25 | 25 | | | 42 | 3016 |
| II-6 | 68 | | | | 25 | 15 | | | 31 | 3944 |
| | $a_{31}$ | $a_{32}$ | $a_{33}$ | $a_{34}$ | $b_{31}$ | $b_{32}$ | $b_{33}$ | $b_{34}$ | | |
| III-1 | 24 | 24 | 24 | 24 | 8 | 8 | 8 | 8 | 30 | 5568 |
| III-2 | 25 | 25 | 25 | 25 | 15 | 15 | 15 | 15 | 31 | 5800 |
| III-3 | 20 | 20 | 20 | 20 | 20 | 20 | 20 | 20 | 43 | 4640 |
| III-4 | 15 | 15 | 15 | 15 | 20 | 20 | 20 | 20 | 50 | 3480 |
| III-5 | 15 | 15 | 15 | 15 | 10 | 10 | 10 | 10 | 33 | 3480 |
| III-6 | 15 | 5 | 15 | 5 | 9 | 3 | 9 | 3 | 31 | 2320 |
| | $a_{41}$ | $a_{42}$ | $a_{43}$ | $a_{44}$ | $b_{41}$ | $b_{42}$ | $b_{43}$ | $b_{44}$ | | |
| IV-1 | 24 | 24 | 24 | 24 | 8 | 8 | 8 | 8 | 20 | 5568 |
| IV-2 | 25 | 25 | 25 | 25 | 15 | 15 | 15 | 15 | 31 | 5800 |
| IV-3 | 20 | 20 | 20 | 20 | 20 | 20 | 20 | 20 | 43 | 4640 |
| IV-4 | 15 | 15 | 15 | 15 | 20 | 20 | 20 | 20 | 50 | 3480 |
| IV-5 | 8.8 | 8.8 | 8.8 | 8.8 | 3.8 | 3.8 | 3.8 | 3.8 | 24 | 2042 |
| IV-6 | 12.5 | 12.5 | 12.5 | 12.5 | 2.8 | 2.8 | 2.8 | 2.8 | 14 | 2900 |

The terminal alkyl modified poly(vinyl alcohol) used in the present invention, which is further modified for having a carboxy group thereto, is preferably employed. Specific examples include a terminal alkyl itaconic acid modified poly (vinyl alcohol) and a terminal alkyl maleic acid modified poly(vinyl alcohol). As the alkyl group described above, preferred is the alkyl group having about 6 to 16 carbon atoms, and more preferably about 8 to 14 carbon atoms. Specific examples of the alkyl group include —$C_8H_{17}$, —$C_9H_{19}$, —$C_{10}H_{21}$, —$C_{11}H_{23}$, —$C_{12}H_{25}$, —$C_{13}H_{27}$, —$C_{14}H_{29}$, and the like. The alkyl group (—R) is preferably located at the end in the form of sulfide (—SR) by sulfur atom (—S—) bonding.

Specific examples of the modified poly(vinyl alcohol) include the compounds described in the explanation of the poly(vinyl alcohols) mentioned below. The terminal alkyl modified poly(vinyl alcohol) includes MP-102, MP-202, and MP-203 (MP polymer series, trade name, available from Kurary Co., Ltd.).

The ratio of the aggregation stabilizer to the polymer latex is preferably in a range of from 0.01% by weight to 5.0% by weight, and more preferably from 0.1% by weight to 1.5% by weight.

Viscosity of the coating solution for the non-photosensitive intermediate layer is preferably in a range of from 1 mPa·s to 1000 mPa·s, more preferably from 1 mPa·s to 200 mPa·s, and even more preferably from 10 mPa·s to 100 mPa·s at 40° C.

The addition amount of the water-soluble polymer as the viscosity increasing agent is not limited as far as the viscosity is increased to a required level on adding to the coating solution. Generally, the concentration in the solution is in a range of from 0.01% by weight to 30% by weight, more preferably from 0.05% by weight to 20% by weight, and particularly preferably from 0.1% by weight to 10% by weight. Viscosity thereby is preferably in a range of from 1 cP to 200 cP, and more preferably from 5 cP to 100 cP, based on the increase from the initial viscosity. The viscosity measurement is performed by using B-type rotary viscometer at 25° C. On adding the viscosity increasing agent to the coating solution, generally the solution diluted as possible is preferred, and thorough stirring during the addition is preferred.

4) Crosslinking Agent

In the present invention, a crosslinking agent is preferably added in any layer on the side having thereon an image forming layer, and more preferably a crosslinking agent is added in the non-photosensitive intermediate layer. The addition of a crosslinking agent can produce an excellent photothermographic material having a non-photosensitive intermediate layer exhibiting a good degree of hydrophobic property and water resistance.

As the crosslinking agent, it is enough that the crosslinking agent has plural groups, which react with an amino group or a carboxy group, in a molecule, and the species of the crosslinking agent are not particularly limited. Examples of the crosslinking agent are described in T. H. James, "THE THEORY OF THE PHOTOGRAPHIC PROCESS, FOURTH EDITION" (Macmillan Publishing Co., Inc., pages 77 to 87, 1977). Both of a crosslinking agent of inorganic compound (for example, chrome alum) and a crosslinking agent of organic compound are preferred, but more preferred is a crosslinking agent of organic compound.

As preferable organic compounds of the crosslinking agent, carboxylic acid derivatives, carbamic acid derivatives, sulfonate ester compounds, sulfonyl compounds, epoxy compounds, aziridine compounds, isocyanate compounds, carbodiimide compounds, and oxazoline compounds can be described. Epoxy compounds, isocyanate compounds, carbodiimide compounds, and oxazoline compounds are more preferred. The crosslinking agent may be used alone or two or more of them may be used in combination.

Specifically, the following compounds are described, however, the present invention is not limited in following examples.

<Carbodiimide>

Water-soluble or water-dispersible carbodiimide compounds are preferred, and as examples, polycarbodiimide derived from isophorone diisocyanate described in JP-A No. 59-187029 and Japanese Patent Application Publication (JP-B) No. 5-27450, carbodiimide compounds derived from tetramethylxylylene diisocyanate described in JP-A No. 7-330849, multi-branched type carbodiimide compounds described in JP-A No. 10-30024, and carbodiimide compounds derived from dicyclohexyl methanediisocyanate described in JP-A No. 2000-7642 can be described.

<Oxazoline Compound>

Water-soluble or water-dispersible oxazoline compounds are preferred, and as example, oxazoline compounds described in JP-A No. 2001-215653 can be described.

<Isocyanate Compound>

Since it is reactable compound with water, water-dispersible isocyanate is preferred from the viewpoint of stability of its solution, and especially that having self-emulsification property is preferred. As examples, water-dispersible isocyanates described in JP-A Nos. 7-304841, 8-277315, 10-45866, 9-71720, 9-328654, 9-104814, 2000-194045, 2000-194237 and 2003-64149 can be described.

<Epoxy Compound>

Water-soluble or water-dispersible epoxy compounds are preferred, and as examples, water-dispersible epoxy compounds described in JP-A Nos. 6-329877 and 7-309954 can be described.

More specific examples of crosslinking agent for use in the present invention are shown below, however the present invention is not limited in the following examples.

<Epoxy Compound>

Trade name: Dickfine EM-60 (Dai Nippon Ink & Chemicals, Inc.)

<Isocyanate Compound>

Trade name: Duranate WB40-100 (Asahi Chemical Industries Co., Ltd.)
Duranate WB40-80D (Asahi Chemical Industries Co., Ltd.)
Duranate WT20-100 (Asahi Chemical Industries Co., Ltd.))
Duranate WT30-100 (Asahi Chemical Industries Co., Ltd.)
CR-60N (Dainippon Ink & Chemicals, Inc.)

<Carbodiimide Compound>

Trade name: Carbodilite V-02 (Nisshinbo Industries, Inc.)
Carbodilite V-02-L2 (Nisshinbo Industries, Inc.)
Carbodilite V-04 (Nisshinbo Industries, Inc.)
Carbodilite V-06 (Nisshinbo Industries, Inc.)
Carbodilite V-02 (Nisshinbo Industries, Inc.)
Carbodilite E-01 (Nisshinbo Industries, Inc.)
Carbodilite E-02 (Nisshinbo Industries, Inc.)

<Oxazoline Compound>

Trade name: Epocros K-1010E (Nippon Shokubai Co., Ltd.)
Epocros K-1020E (Nippon Shokubai Co., Ltd.)
Epocros K-1030E (Nippon Shokubai Co., Ltd.)
Epocros K-2010E (Nippon Shokubai Co., Ltd.)
Epocros K-2020E (Nippon Shokubai Co., Ltd.)
Epocros K-2030E (Nippon Shokubai Co., Ltd.)
Epocros WS-500 (Nippon Shokubai Co., Ltd.)
Epocros WS-700 (Nippon Shokubai Co., Ltd.)

The crosslinking agent for use in the present invention may be added by mixing it in a solution for binder in advance, or may be added at the end of the preparing process of the coating solution. Or, the crosslinking agent can be added just prior to coating.

The addition amount of the crosslinking agent for use in the present invention is preferably from 0.5 part by weight to 200 part by weight with respect to 100 part by weight of a binder in a component layer including the crosslinking agent, more preferably from 2 part by weight to 100 part by weight, and even more preferably from 3 part by weight to 50 part by weight.

Various additives other than the binder can be incorporated in the non-photosensitive intermediate layer. In addition to the crosslinking agent and viscosity increasing agent set forth above, examples of the additives include a surfactant, a pH controlling agent, an auxiliary film-forming agent, inorganic fine particles, and the like.

(Outermost Layer)

The non-photosensitive layer constituting the outermost layer which is disposed on the side of the support having thereon the image forming layer according to the present invention will be explained below.

The outermost layer preferably contains, other than the binder, various additives such as a matting agent, a lubricant, a surfactant, and the like in order to improve film transportability and surface protection of the photothermographic material.

A mean thickness of the outermost layer of the present invention is preferably in a range of from 0.1 μm to 0.45 μm, more preferably from 0.2 μm to 0.45 μm, and even more preferably from 0.3 μm to 0.45 μm.

If the average thickness of the outermost layer of the present invention exceeds the above range, image stability is unfavorably degraded, whereas if it is below the above range, the surface is too liable to be scratched.

The total amount of binder incorporated in the outermost layer of the present invention is preferably in a range of from 0.1 $g/m^2$ to 0.45 $g/m^2$, more preferably from 0.2 $g/m^2$ to 0.45 $g/m^2$, and even more preferably from 0.3 $g/m^2$ to 0.45 $g/m^2$.

<Binder>

As the binder for the outermost layer of the present invention, a hydrophilic polymer having setting ability is preferably employed.

The hydrophilic polymer according to the present invention is preferably a hydrophilic polymer derived from animal protein. The hydrophilic polymer derived from animal protein means natural or chemically modified water-soluble polymer such as glue, casein, gelatin, egg white, or the like. It is preferably gelatin, in which are acid-processed gelatin and alkali-processed gelatin (lime-processed gelatin or the like) depending on a synthetic method and any of them can be preferably used. A molecular weight of gelatin used is preferably from 10,000 to 1,000,000. Modified gelatin, which is obtained by modifying a gelatin utilizing an amino group or a carboxy group of gelatin (e.g., phthalated gelatin or the like), can be also used. As gelatin, there can be used an inert gelatin (e.g., Nitta gelatin 750), a phthalated gelatin (e.g., Nitta gelatin 801), and the like.

In an aqueous gelatin solution, solation occurs when gelatin is heated to 30° C. or higher, and gelling occurs and the solution loses fluidity when it is cooled to lower than 30° C. As this sol-gel exchange occurs reversibly, an aqueous gelatin solution as a coating solution has a setting ability. That means gelatin solution loses fluidity when it is cooled to lower than 30° C.

In combination with the hydrophilic polymer derived from animal protein, the hydrophilic polymer not derived from animal protein and the hydrophobic polymer latex, which are described below, can be employed in such a range as the setting ability is maintained. Generally, the mixed limit of the hydrophilic polymer not derived from animal protein and the hydrophobic polymer latex with the hydrophilic polymer derived from animal protein is present in around 40% by weight, more preferably around 30% by weight.

The hydrophilic polymer which is not derived from animal protein according to the present invention means a natural polymer (polysaccharide series, microorganism series, or animal series) other than animal protein such as gelatin or the like, a semi-synthetic polymer (cellulose series, starch series, or alginic acid series), and a synthetic polymer (vinyl series or others) and corresponds to synthetic polymer such as poly (vinyl alcohol) described below and natural or semi-synthetic polymer made by cellulose or the like derived from plant as a raw material. Poly(vinyl alcohols) and acrylic acid-vinyl alcohol copolymers are preferable.

The hydrophilic polymer which is not derived from animal protein has no setting ability, but when it is used in combination with the gelling agent, this has a setting ability and thus, coating ability becomes preferable.

The hydrophobic polymer latex according to the present invention is preferably a polymer latex having an equilibrium water content of 5% by weight or lower under 25° C. and 60% RH. The term "equilibrium water content under 25° C. and 60% RH" as referred herein can be expressed as follows:

$$\text{Equilibrium water content under 25° C. and 60\% RH} = [(W1 - W0)/W0] \times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

The equilibrium water content under 25° C. and 60% RH is preferably 2% by weight or lower, and is more preferably, in a range of from 0.01% by weight to 1.5% by weight, and is even more preferably, from 0.02% by weight to 1% by weight.

The glass transition temperature (Tg) of the hydrophobic polymer latex is preferably in a range of from 0° C. to 80° C., more preferably from 10° C. to 70° C. and, even more preferably from 15° C. to 60° C.

Preferred embodiment of the hydrophobic polymer latex is such prepared to yield an ion conductivity of 2.5 mS/cm or lower, and as such a preparing method, there can be mentioned a refining treatment using a separation function membrane after synthesizing the polymer.

The average particle diameter of the hydrophobic polymer latex particles according to the present invention is preferably in a range of from 1 nm to 50,000 nm, more preferably from 10 nm to 500 nm, and even more preferably from 50 nm to 200 nm. There is no particular limitation concerning a particle diameter distribution, and they may be widely distributed or may exhibit a monodisperse particle diameter distribution. From the viewpoint of controlling physical properties of the coating solution, preferred mode of usage includes mixing two or more types of particles each having monodisperse particle diameter distribution.

Specific examples of preferred hydrophobic polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

NP-1; Latex of -MMA(70)-EA(27)-MAA(3)-(molecular weight 37000, Tg 61° C.)

NP-2; Latex of -MMA(70)-2EHA(20)-St(5)-AA(5)-(molecular weight 40000, Tg 59° C.)

NP-3; Latex of -St(50)-Bu(47)-MAA(3)-(crosslinking, Tg −17° C.)

NP-4; Latex of -St(68)-Bu(29)-AA(3)-(crosslinking, Tg 17° C.)

NP-5; Latex of -St(71)-Bu(26)-AA(3)-(crosslinking, Tg 24° C.)

NP-6; Latex of -St(70)-Bu(27)-IA(3)-(crosslinking)

NP-7; Latex of -St(75)-Bu(24)-AA(1)-(crosslinking, Tg 29° C.)

NP-8; Latex of -St(60)-Bu(35)-DVB(3)-MAA(2)-(crosslinking)

NP-9; Latex of -St(70)-Bu(25)-DVB(2)-AA(3)-(crosslinking)

NP-10; Latex of -VC(50)-MMA(20)-EA(20)-AN(5)-AA(5)-(molecular weight 80000)

NP-11; Latex of -VDC(85)-MMA(5)-EA(5)-MAA(5)-(molecular weight 67000)

NP-12; Latex of -Et(90)-MAA(10)-(molecular weight 12000)

NP-13; Latex of -St(70)-2EHA(27)-AA(3)-(molecular weight 130000, Tg 43° C.)

NP-14; Latex of -MMA(63)-EA(35)-AA(2)-(molecular weight 33000, Tg 47° C.)

NP-15; Latex of -St(70.5)-Bu(26.5)-AA(3)-(crosslinking, Tg 23° C.)

NP-16; Latex of -St(69.5)-Bu(27.5)-AA(3)-(crosslinking, Tg 20.5° C.)

NP-17; Latex of -St(61.3)-Isoprene(35.5)-AA(3)-(crosslinking, Tg 17° C.)

NP-18; Latex of -St(67)-Isoprene(28)-Bu(2)-AA(3)-(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

As the polymer latex used for the hydrophobic polymer layer of the present invention, particularly, latexes of acrylate copolymer, latexes of polyester, polyurethane, and the like are preferred.

Further, the polymer latex used for the hydrophobic polymer layer of the present invention preferably contains acrylic acid or methacrylic acid within an amount of from 1% by weight to 6% by weight, and more preferably from 2% by weight to 5% by weight. The polymer latex used for the hydrophobic polymer layer of the invention preferably contains acrylic acid.

The concentration in a solution is not limited as far as the viscosity is preferably adjusted to be suited for the simultaneously multilayer coating process on addition. Generally the concentration in a solution is preferably in a range of from 5% by weight to 50% by weight, more preferably from 10% by weight to 40% by weight, and still more preferably from 15% by weight to 30% by weight.

<Matting Agent>

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range of from 1 mg/m$^2$ to 400 mg/m$^2$, and more preferably, from 5 mg/m$^2$ to 300 mg/m$^2$, with respect to the coating amount per 1 m$^2$ of the photothermographic material.

The shape of the matting agent usable in the invention may be a fixed form or non-fixed form. Preferred is to use those having fixed form and globular shape.

Volume weighted mean equivalent spherical diameter of the matting agent used in the image forming layer surface is preferably in a range of from 0.3 μm to 10 μm, and more preferably, from 0.5 μm to 7 μm. Further, the particle distribution of the matting agent is preferably set as such that the variation coefficient becomes from 5% to 80%, and more preferably, from 20% to 80%. The variation coefficient, herein, is defined by (the standard deviation of particle diameter)/(mean diameter of the particle)×100. Furthermore, two or more types of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range of from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more types of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more when expressed by Beck's smoothness.

In the present invention, a matting agent is preferably contained in the outermost layer, in a layer which functions as a surface protective layer, or in a layer near to the outermost layer.

<Lubricant>

To improve handling facility during manufacturing process or resistance to scratch during thermal development, it is preferred to use a lubricant such as a liquid paraffin, a long chain fatty acid, an amide of a fatty acid, an ester of a fatty acid, or the like. Particularly preferred are a liquid paraffin obtained by removing components having a low boiling point, and an ester of a fatty acid having a branch structure and a molecular weight of 1000 or more.

Concerning lubricants, compounds described in paragraph No. 0117 of JP-A No. 11-65021 and in JP-A Nos. 2000-5137, 2004-219794, 2004-219802, and 2004-334077 are preferable.

The addition amount of the lubricant is in a range of from 1 mg/m$^2$ to 200 mg/m$^2$, preferably from 10 mg/m$^2$ to 150 mg/m$^2$, and more preferably in a range of from 20 mg/m$^2$ to 100 mg/m$^2$.

The lubricant is added in any layer of the image forming layer and the non-image-forming layer, but from the purpose to improve transportability and resistance to scratches, it is preferred to add the lubricant in the outermost layer.

<Surfactant>

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2003-149766 are preferably used. Especially, the usage of the fluorocarbon surfactants described in JP-A Nos. 2003-57780 and 2003-149766 in an aqueous coating solution is preferred viewed from the standpoint of capacity in static control, stability of the coated surface state and sliding facility. The fluorocarbon surfactant described in JP-A No. 2003-149766 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2003-149766 is greatly effective, and used preferably in a range of from 0.01 mg/m$^2$ to 10 mg/m$^2$, and more preferably, in a range of from 0.1 mg/m$^2$ to 5 mg/m$^2$.

(Organic Silver Salts and/or Inorganic Silver Compound Incorporated in Non-Photosensitive Layer)

According to the present invention, it is preferred that the non-photosensitive layer contains at least one of an organic silver salt or an inorganic silver compound. As the said non-photosensitive layer, at least one layer selected from the non-photosensitive intermediate layer and the outermost layer is preferred. The above will be explained below in detail.

In the case where at least one of either organic silver salt or inorganic silver compound is used, at least one non-photosensitive layer is disposed on the same side of the support as image forming layer and farther from the support than the image forming layer, and the non-photosensitive layer described above contains the organic silver salt and/or the inorganic silver compound.

First, the organic silver salt will be explained below.

The organic silver salt, which is incorporated in the non-photosensitive layer of the present invention, preferably includes a silver salt of a fatty acid, a silver salt of a mercapto compound, a silver salt of a nitrogen-containing heterocyclic compound, a silver salt of an aromatic carboxylic acid, and a silver salt of a poly-carboxylic acid.

The non-photosensitive layer containing the organic silver salt described above is at least one layer which is disposed on the same side of the support as the image forming layer and farther from the support than the image forming layer and includes the following surface protective layer, intermediate layer which is disposed between the surface protective layer and the image forming layer, and the like. The organic silver salt is included in at least one layer of these non-photosensitive layers.

The silver salt of a fatty acid is a silver salt of an aliphatic carboxylic acid which has 1 to 30 carbon atoms and may be linear or branched, saturated or unsaturated.

Preferred examples of the silver salt of a fatty acid include silver lignocerate, silver behenate, silver arachidinate, silver stearate, silver oleate, silver linoleate, silver laurate, silver capronate, silver myristate, silver palmitate, silver erucate, silver acetate, silver butyrate, silver propionate, silver valerate, silver enanthate, silver caprylate, silver pelargonate, silver decanoate, and mixtures thereof. Among them, particularly preferred are silver behenate, silver stearate, silver laurate, silver oleate, silver lignocerate, and silver arachidinate.

Concerning the silver salt of a mercapto compound, preferred examples of the mercapto compound include an aliphatic mercapto compound and a heterocyclic mercapto compound. In the case of the aliphatic mercapto compound, the compound preferably has 10 to 30 carbon atoms, and more preferably 10 to 25 carbon atoms. The aliphatic mercapto compound may be linear or branched, saturated or unsaturated, and unsubstituted or substituted. In the case where the aliphatic mercapto compound has a substituent, the substituent is not particularly limited, but an alkyl group is preferred.

Preferred aliphatic group for the aliphatic mercapto compound is an alkyl group, more preferably an alkyl group having 10 to 23 carbon atoms, which include substituted or unsubstituted, and linear or branched.

Representative examples of the silver salt of an aliphatic mercapto compound are described below, but are not limited to these compounds. For example, there are included a silver salt of an alkylthiol compound having 10 to 25 carbon atoms, and preferably a silver salt of an alkylthiol compound having 10 to 23 carbon atoms.

In the case of a silver salt of a heterocyclic mercapto compound, preferred examples of the heterocycle include a nitrogen-containing heterocycle, a sulfur-containing heterocycle, an oxygen-containing heterocycle, and a selenium-containing heterocycle, more preferred are a nitrogen-containing heterocycle, a sulfur-containing heterocycle, and an oxygen-containing heterocycle. Specific examples of the silver salt of a nitrogen-containing heterocyclic mercapto compound are described below, but are not limited to these examples.

A silver salt of 3-mercapto-4-phenyl-1,2,4-triazole,
a silver salt of 2-mercapto-benzimidazole,
a silver salt of 2-mercapto-5-aminothiazole,
a silver salt of mercaptotriazine,
a silver salt of 2-mercaptobenzoxazole,
a silver salt of the compound described in (USP) U.S. Pat. No. 4,123,274 (Knight, et al) (for example, a silver salt of 1,2,4-mercaptothiazole derivative, a silver salt of 3-amino-5-benzylthio-1,2,4-thiazole), and a silver salt of a thione compound (for example, a silver salt of 3-(2-carboxyethyl)-4-methyl-4-thiazoline-2-thione described in U.S. Pat. No. 3,785,830 (Sullivan, et al)).

Concerning the silver salt of a nitrogen-containing heterocyclic compound, specific examples of the nitrogen-containing heterocyclic compound include, but are not limited to these examples, azoles, oxazoles, thiazoles, thiazolines, imidazoles, diazoles, pyridines, indolizines, and triazines. Among them, more preferred are indolizines, imidazoles, and azoles. Preferred examples of the azoles include triazole, tetrazole, and their derivatives. More preferred are benzimidazoles and derivatives thereof, and benzotriazole and derivatives thereof.

Preferred example of the indolizines is a triazaindolizine derivative.

Representative examples of the nitrogen-containing heterocyclic compound further include, but are not limited to these examples, 1,2,4-triazole, benzotriazoles and derivatives thereof, and preferred are benzotriazole, methylbenzotriazole, and 5-chlorobenzotriazole. Further, 1H-tetrazole compounds such as phenylmercaptotetrazole described in U.S. Pat. No. 4,220,709 (de Mauriac), and imidazole and imidazole derivatives described in U.S. Pat. No. 4,260,677 (Winslow, et al) can be described, and benzimidazole and nitrobenzimidazole are preferred. As a triazaindolizine derivative, preferred is 5-methyl-7-hydroxy-1,3,5-triazaindolizine, but the invention is not limited to the compound.

Concerning the silver salt of an aromatic carboxylic acid, the aromatic carboxylic acid is an unsubstituted or substituted benzenecarboxylic acid where the substituent is not particularly limited. Preferred are benzoic acid and derivatives thereof, and salicylic acid and derivatives thereof.

The silver salt of a poly-carboxylic acid is a silver salt of a polyvalent carboxylic acid. A silver salt of a low-molecular poly-carboxylic acid is represented by the following formula (CI).

$$M^1O_2C\text{-}L^1\text{-}CO_2M^2 \qquad \text{Formula (CI)}$$

In formula (CI), $L^1$ represents an alkylene group, an alkenylene group, an alkynylene group, a cycloalkylene group, an arylene group, a divalent heterocyclic group, a divalent group selected from —C(=O)—, —O—, —S—, —S(=O)—, —S(=O)$_2$—, and —N($R^1$)—, or a divalent group formed by combining these groups. $L^1$ may further have a substituent.

$R^1$ represents a hydrogen atom or a substituent. $M^1$ and $M^2$ each independently represent a hydrogen atom or a counter ion where at least one of $M^1$ and $M^2$ represents a silver ion (I). Furthermore, the compound represented by formula (CI) may further have a carboxy group or a salt thereof.

Specific examples of the compound mentioned above include, but are not limited to these examples, the compounds represented by chemical formulae Nos. 2 to 16 in paragraph Nos. 0024 to 0044 of JP-A No. 2003-330139.

Preferred examples of the carboxylic acid used for forming a silver salt of a low-molecular poly-carboxylic acid include phthalic acid, isophthalic acid, terephthalic acid, malic acid, citric acid, malonic acid, succinic acid, maleic acid, fumaric acid, hemimellitic acid, trimellitic acid, trimesic acid, mellophanic acid, prehnitic acid, pyromellitic acid, oxalic acid, adipic acid, gultaric acid, pimelic acid, suberic acid, azelaic acid, sebacic acid, and naphthalenedicarboxylic acid. Among them, particularly preferred are phthalic acid, succinic acid, adipic acid, glutaric acid, and naphthalenedicarboxylic acid. With respect to plural carboxylic acids, at least one of the carboxylic acids forms a silver salt.

A silver salt of a high-molecular poly-carboxylic acid is a silver salt of a polymer having a repeating unit derived from a monomer containing a carboxy group. Preferred compound can be represented by the following formula (CII).

$$-(A)_a-(B)_b- \qquad \text{Formula (CII)}$$

In formula (CII), A represents a repeating unit derived from a monomer containing a carboxy group. B represents a repeating unit derived from an ethylenic unsaturated monomer except A. a represents a number of from 5 to 100 in terms of % by weight. b represents a number of from 0 to 95 in terms of % by weight. a+b is equal to 100% by weight.

Preferably, a is a number of from 50 to 100 in terms of % by weight, b is a number of from 0 to 50 in terms of % by weight, and a+b is equal to 100% by weight.

Specifically, the detail explanation is mentioned in paragraph Nos. 0013 to 0074 of JP-A No. 2003-330137.

Specific examples of the carboxylic acid include the compounds described below, but are not limited to these examples. The silver salt formed with the said carboxylic acid is a silver salt of a high-molecular poly-carboxylic acid, which may have at least one silver carboxylate in a molecule.

P-1

$$-(CH_2-\underset{\underset{COOH}{|}}{CH})- \qquad Mw = 46000$$

P-2

$$-(CH_2-\underset{\underset{COOH}{|}}{CH})_a-(CH_2-\underset{\underset{C_6H_5}{|}}{CH})_b- \qquad a/b = 80/20,\ Mw = 37000$$

P-3

$$nC_{12}H_{25}S-(CH_2-\underset{\underset{COOH}{|}}{CH})_m-H \qquad m = 5.1$$

P-4

$$nC_{12}H_{25}S-(CH_2-\underset{\underset{COOH}{|}}{CH})_a-(CH_2-\underset{\underset{CONH_2}{|}}{CH})_b-H \qquad a/b = 75/25,\ m = 14.6$$

-continued

P-5

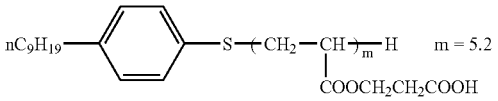

P-6

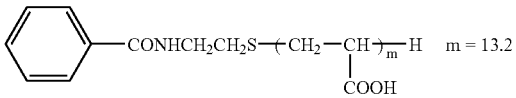

Among the organic silver salts described above, preferred examples of the silver salt of a fatty acid include silver behenate, silver stearate, silver laurate, silver oleate, silver lignoceratе, and silver arachidinate. Preferred examples of the silver salt of a mercapto compound include a silver salt of 3-mercapto-4-phenyl-1,2,4-triazole, a silver salt of 2-mercaptobenzimidazole, and a silver salt of 2-mercapto-5-aminothiazole. Preferred examples of the silver salt of a nitrogen-containing heterocyclic compound include a silver salt of benzotriazole, a silver salt of methylbenzotriazole, a silver salt of benzimidazole, a silver salt of nitrobenzimidazole, and a silver salt of 5-methyl-7-hydroxy-1,3,5-triazaindolizine. Preferred examples of the silver salt of a poly-carboxylic acid include silver phthalate, silver succinate, silver adipate, silver glutarate, and silver naphthalenedicarboxylate. Preferred examples of the silver salt of a high-molecular poly-carboxylic acid include a silver salt of the compound selected from P-1, P-3, and P-5 mentioned above.

Syntheses of the silver salt of a fatty acid and the silver salt of an aliphatic mercapto compound can be carried out according to the conventional methods known in the art. For example, an aliphatic mercapto compound is melted in water by heating at a temperature above the melting point (generally, from 10° C. to 90° C.), and then a sodium salt thereof is formed with sodium hydroxide. Thereafter, the sodium salt is reacted with silver nitrate to form crystal of a silver salt of an aliphatic mercapto compound. The obtained silver salt can be dispersed using a suitable dispersing agent to prepare a dispersion thereof. In this preparing process for forming crystal of a silver salt of a fatty acid or a silver salt of an aliphatic mercapto compound, dispersion of the silver salt of a fatty acid or silver salt of an aliphatic mercapto compound may be performed in the presence of hydrophilic colloid such as gelatin. Another method for bringing the silver salt comprises a step of adding a fatty acid or an aliphatic mercapto compound in a reaction vessel and thereto adding silver nitrate.

A silver salt of a heterocyclic mercapto compound and a silver salt of a low-molecular poly-carboxylic acid can be prepared similarly. As an alternative method, for example, preparation can be easily performed for technician in the art, according to the method described in "Jikken Kagaku Koza" (Lecture Series on Experimental Chemistry), 4th Ed, vol. 22, pp. 1 to 43, and pp. 193 to 227. edited by the Chemical Society of Japan, and the references cited above. A silver salt of a nitrogen-containing heterocyclic compound and a silver salt of a heterocyclic mercapto compound can also be prepared by the method described in JP-A No. 1-100177.

A silver salt of a high-molecular poly-carboxylic acid can be prepared by a similar method described above.

Next, the inorganic silver compound will be explained below.

The inorganic silver compound is preferably at least one compound selected from a silver compound carried on silicate or a derivative thereof, a silver compound carried on phosphate or a derivative thereof, and a silver compound carried between layers of an inorganic layered compound.

The silver compound carried on silicate or a derivative thereof is preferably silver zeolite, silver calcium, magnesium metasilicate aluminate, or silver silica gel, and more preferably silver zeolite.

The silver compound carried on phosphate or a derivative thereof is a silver compound carried on calcium phosphate or zirconium phosphate.

The silver compound carried between layers of an inorganic layered compound is preferably a silver compound carried on montmorillonite or synthetic smectite.

The silver potential of an aqueous dispersion of the inorganic silver salt is preferably in a range of from +50 mV to +700 mV with respect to a standard hydrogen electrode at 25° C., and more preferably from +250 mV to +650 mV.

The solvent for the coating solution for the image forming layer of the present invention preferably contains water in an amount of 50% by weight or more.

And the binder for the image forming layer preferably comprises a hydrophobic polymer latex in an amount of 50% by weight or more.

50% by weight or more of the solvent for the coating solution for the non-photosensitive layer is preferably water and 50% by weight or more of the binder of the non-photosensitive layer is preferably a hydrophobic polymer latex or a hydrophilic polymer, and more preferably gelatin.

The photothermographic material of the present invention preferably has a non-photosensitive layer containing a hydrophobic polymer latex in an amount of 50% by weight or more, based on the binder, between the image forming layer and the non-photosensitive layer containing the organic silver salt described above.

By the above means, print-out resistance after image formation and raw stock storability of the photothermographic material can be improved, especially image color change or discolor occurred on the portion attached with finger print or sweat are improved.

Examples of the preferred inorganic silver compound used for the non-photosensitive layer of the present invention include a silver compound carried on silicate or a derivative thereof, a silver compound carried on phosphate or a derivative thereof, and a silver compound carried between layers of an inorganic layered compound.

The non-photosensitive layer containing the inorganic silver compound is disposed on the same side of the support as the image forming layer and farther from the support than the image forming layer, which is a surface protective layer or an intermediate layer disposed between the surface protective layer and the image forming layer, which are described below.

The inorganic silver compound may be incorporated in either one or plural layers of the non-photosensitive layer.

<Silver Compound Carried on Silicate or a Derivative Thereof>

The silver compound is a compound in which a silver ion is carried on silicate or a derivative thereof. Examples of the silicate include zeolite, mineral clay, silica gel, silica/alumina, magnesium metasilicate alminate, and glass. Among these, preferred are zeolite and silica gel, and more preferred is zeolite.

One example of the synthetic method of silver zeolite comprises a step of suspending A-type synthetic zeolite in water, adding a silver nitrate solution thereto, replacing a definite quantity of the sodium ion in the crystal structure with the silver ion by an ion exchange reaction, and thereafter subjecting to a baking process after drying thereof.

<Silver Compound Carried on Phosphate or a Derivative Thereof>

The silver compound is a compound in which a silver ion is carried on phosphate or a derivative thereof. Examples of the phosphate include calcium phosphate, zirconium phosphate, and hydroxyapatite. Preferred are calcium phosphate and zirconium phosphate.

One example of the synthetic method comprises a step of mixing an aqueous calcium phosphate suspension with a silver nitrate solution, carrying the silver ion in the crystal structure by an ionic interaction or an intermolecular force and thereafter stabilized by a baking process.

<Silver Compound Carried Between Layers of Inorganic Layered Compound>

The inorganic layered compound is a compound selected from the group consisting of montmorillonite, bentonite, bidelite, chlorite, hectolite, teniolite, vermiculite, synthetic mica, synthetic smectite, their substituted analogs, and mixtures thereof. The preparing method of the silver compound carried between layers of the inorganic layered compound used for the present invention is as follows; while keeping the above inorganic layered compound being suspended in water, silver nitrate or silver acetate is added thereto as the silver ion supplying source with stirring, and after ion exchange operation, the resulting mixture is subjected to centrifugal separation or filtration to separate the solid. The silver compound is prepared by washing the solid with water until the electric conductivity of the filtrate reaches to 30 μS/cm.

<More Preferred Silver Salt>

Among the silver compounds carried on silicate or a derivative thereof, preferred is silver zeolite. Among the silver compounds carried on phosphate or a derivative thereof, preferred is a silver compound carried on calcium phosphate or zirconium phosphate. Among the silver compounds carried between layers of the inorganic layered compound, preferred is a silver compound carried on synthetic smectite or montmorillonite.

<Preparing Method of Inorganic Silver Compound>

The inorganic silver compounds can be prepared according to the above method. The compounds can be coated by adding them to the coating solution after dispersing them, if necessary. Concerning dispersing method, known techiniques can be applied, and the inorganic silver compounds may be incorporated into a photothermographic material by being added into the coating solution, such as in the form of an emulsified dispersion, a solid fine particle dispersion, or the like.

As well known emulsified dispersing method, there can be mentioned a method comprising dissolving the inorganic silver compound in an oil such as dibutylphthalate, tricresylphosphate, dioctylsebacate, tri(2-ethylhexyl)phosphate, or the like, using an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate, or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the inorganic silver compound in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm.

It is practically acceptable so long as Zr is incorporated in the photothermographic material in an amount of 0.5 mg or less per 1 g of silver.

<Range of Addition Amount>

The addition amount of the organic silver salt and/or the inorganic silver compound, which are/is added to the non-photosensitive layer of the present invention, is from 0.001 $g/m^2$ to 3 $g/m^2$ in terms of a silver amount, preferably from 0.005 $g/m^2$ to 1 $g/m^2$, and more preferably from 0.01 $g/m^2$ to 0.5 $g/m^2$.

<Range of Silver Potential and Measuring Method>

Measurement of silver potentials of a dispersion or an aqueous solution of the organic silver salt and/or the inorganic silver compound, which are/is added to the non-photosensitive layer of the present invention, is carried out as follows; a silver electrode is used as an electrode, and the potential difference of the sample is measured using a saturated calomel electrode as a reference electrode at 40° C. while adjusting the pH thereof at 6. Thereafter, the obtained potential is converted to the value based on a standard hydrogen electrode as a reference electrode. The silver potential is preferably from +50 mV to +700 mV (with respect to a standard hydrogen electrode), more preferably from +250 mV to +650 mV, and particularly preferably from +400 mV to +600 mV.

(Binder for Image Forming Layer)

Any kind of polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent, or emulsion to form a coating solution.

The glass transition temperature (Tg) of the binder is in a range of from 0° C. to 80° C., preferably from 10° C. to 70° C. and, more preferably from 15° C. to 60° C.

The binder may be two or more polymers depending on needs. And, the polymer having Tg of 20° C. or more and the polymer having Tg of less than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The equilibrium water content under 25° C. and 60% RH is preferably 2% by weight or lower, more preferably in a range of from 0.01% by weight to 1.5% by weight, and even more preferably from 0.02% by weight to 1% by weight.

The binder used in the invention is particularly preferably polymer capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle diameter distribution.

From the viewpoint of controlling the physical properties of the coating solution, preferred mode of usage includes mixing two or more types of dispersed particles each having monodisperse particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor.

Further, crosslinking polymer latexes are particularly preferred for use.

<Examples of Latex>

Specific examples of preferred polymer latexes are given below, which are expressed by the starting monomers with % by weight given in parenthesis. The molecular weight is given in number average molecular weight.

In the case polyfunctional monomer is used, the concept of molecular weight is not applicable because they build a crosslinked structure. Hence, they are denoted as "crosslinking", and the molecular weight is omitted. Tg represents the glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable Latexes>

Particularly preferable as the polymer latex for use in the invention is that of styrene-butadiene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range of from 1% by weight to 6% by weight with respect to the sum of styrene and butadiene, and more preferably from 2% by weight to 5% by weight.

The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol Lx416, and the like.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added in an amount of 30% by weight or less, and preferably 20% by weight or less, with respect to the total weight of the binder incorporated in the image forming layer.

According to the invention, the layer containing organic silver salt (image forming layer) is preferably formed by using a polymer latex for the binder. According to the amount of the binder for the image forming layer, a mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, a mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

<Preferred Solvent of Coating Solution>

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Non-Photosensitive Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof. In the present invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being lower than 5 are also used preferably. Such organic silver particles suffer less from fogging during thermal development compared with long needle-like particles with the major axis to minor axis length ratio of 5 or higher. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$. In particular, in order to improve image storability, the total amount of coated silver is preferably 1.8 $mg/m^2$ or less, and more preferably 1.6 $mg/m^2$ or less.

In the case where a preferable reducing agent in the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) capable of reducing silver ions into metallic silver. Examples of the reducing agent are described in JP-A No. 11-65021 (column Nos. 0043 to 0045) and EP No. 0803764 (p.7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

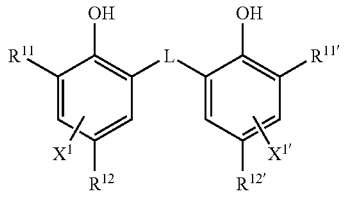

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for R can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group. $R^{13}$ is preferably a hydrogen atom or an alkyl group having 1 to 15 carbon atoms. The alkyl group is preferably a chain or a cyclic alkyl group. And, a group which has a C=C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like). In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agents of the invention including the compounds represented by formula (R) according to the invention are shown below, but the invention is not restricted to these.

R-1

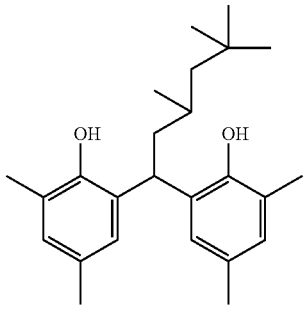

R-2

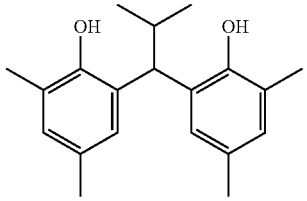

R-3

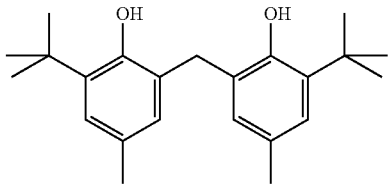

R-4

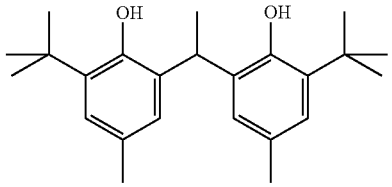

R-5

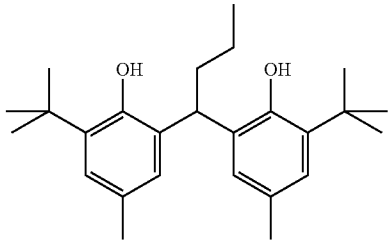

-continued
R-6
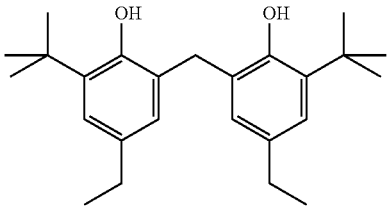
R-7
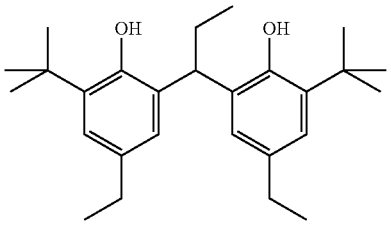
R-8
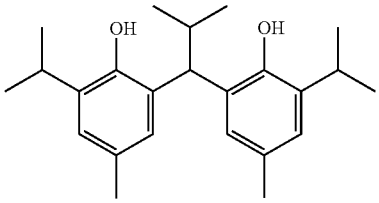
R-9
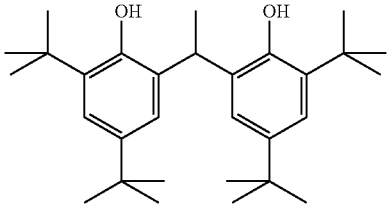
R-10
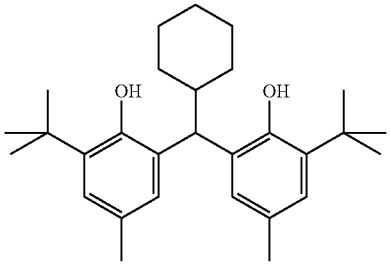
R-11
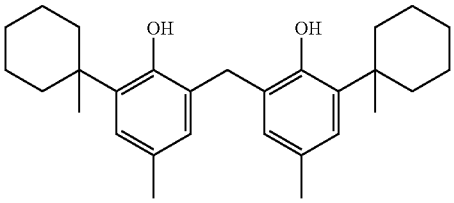
R-12
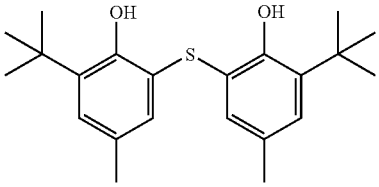
-continued
R-13
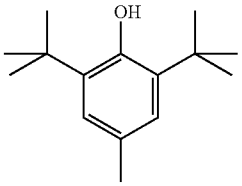
R-14
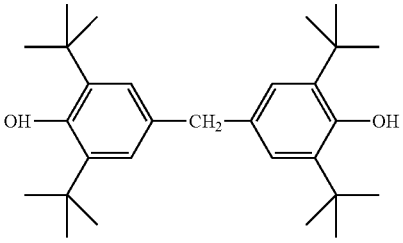
R-15
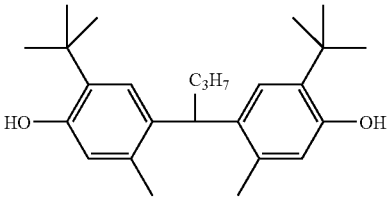
R-16
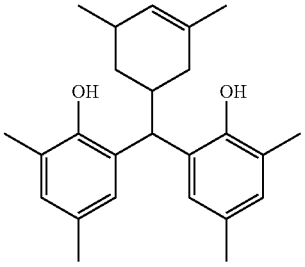
R-17
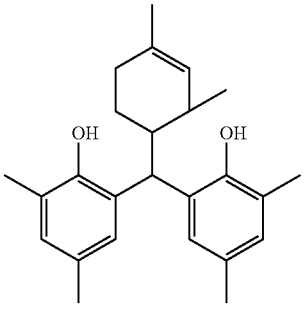
R-18
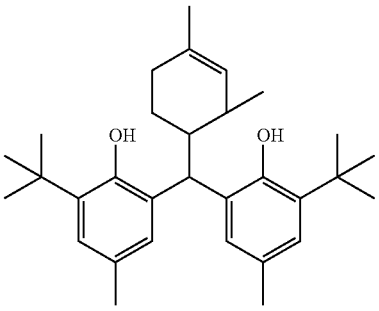

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer.

The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the reducing agent in an oil such as dibutylphthalate, tricresylphosphate, dioctylsebacate, tri(2-ethylhexyl)phosphate, or the like, using an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsified dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm.

In the invention, other solid dispersions are preferably used with this particle size range.

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent having a low boiling point, or to add as a so-called oilless emulsified dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$$Q_1\text{-NHNH-}Q_2 \qquad \text{Formula (A-1)}$$

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group and, particularly, a carbamoyl group having a hydrogen atom on the nitrogen atom is preferred.

Formula (A-2)

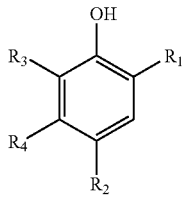

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

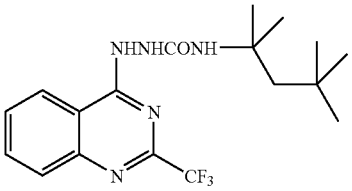

A-2

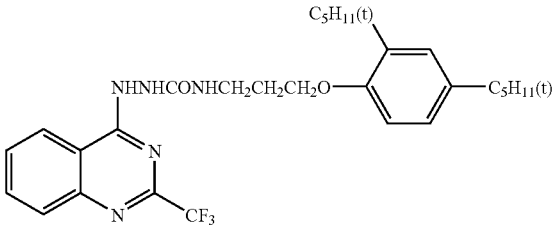

A-3

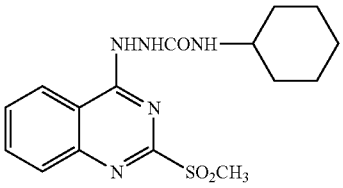

A-4

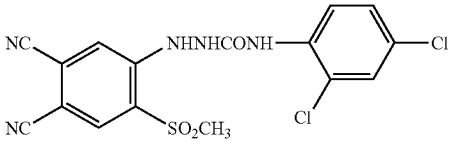

A-5

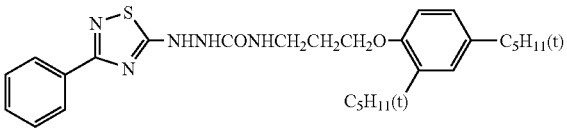

A-6

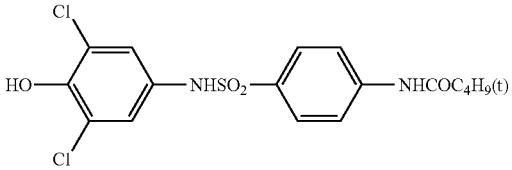

A-7

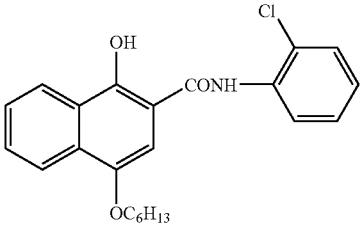

-continued

A-8

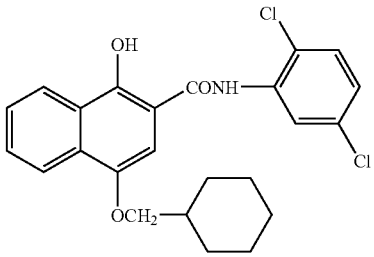

A-9

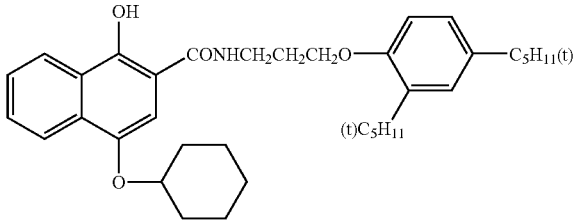

A-10

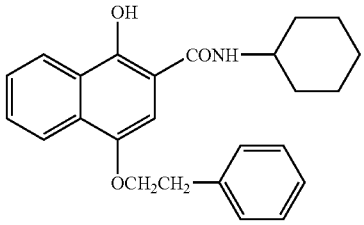

A-11

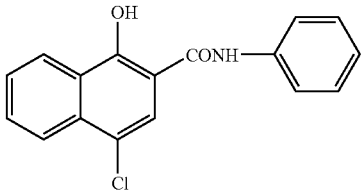

A-11

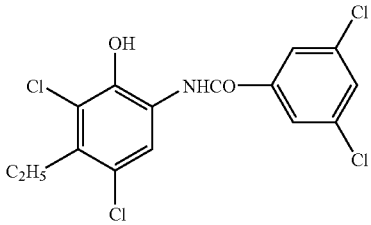

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)- (where, Ra represents a substituent other than H)), a urethane group (not having —N(H)— moiety but being blocked in the form of —N(Ra)- (where, Ra represents a substituent other than H)), and a ureido group (not having —N(H)— moiety but being blocked in the form of —N(Ra)- (where, Ra represents a substituent other than H)).

In the invention, particularly preferable as the hydrogen bonding compound is the compound expressed by formula (D) shown below.

Formula (D)

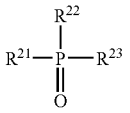

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others are shown below, the invention is not limited thereto.

D-1

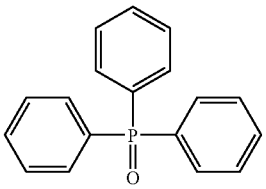

D-2

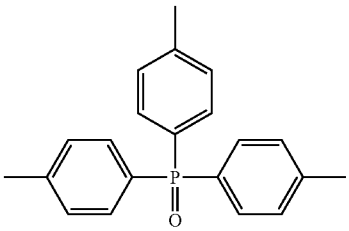

D-3

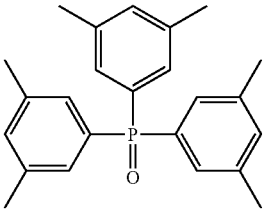

D-4

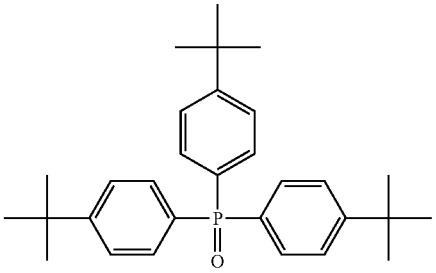

D-5

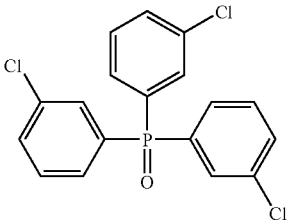

D-6

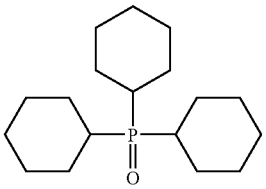

-continued

D-7

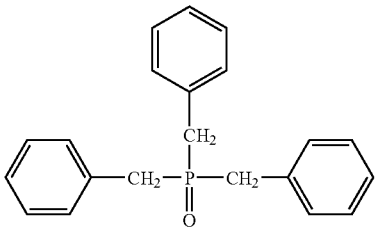

D-8

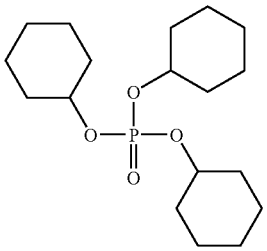

D-9

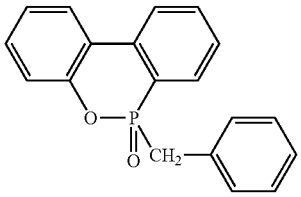

D-10

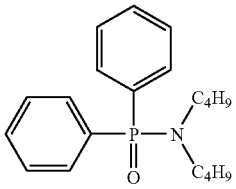

D-11

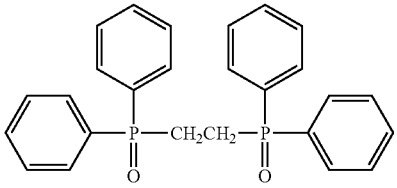

D-12

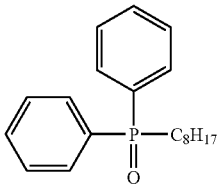

D-13

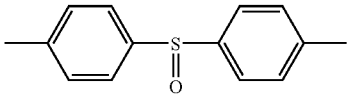

D-14

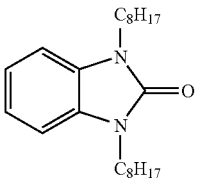

-continued

D-15

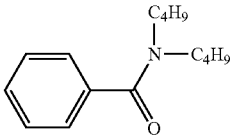

Specific examples of the hydrogen bonding compound other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide, or silver chlorobromide grains can also be used preferably.

2) Method of Grain Formation

The method of forming photosensitive silver halide is well-known in the relevant art and, for example, methods described in Research Disclosure No. 10729, June 1978 and (USP) U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, potato-like shape, and the like. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, redissolution with fine grains can be prevented and fine silver halide grains with smaller grain size can be prepared.

Metal atoms that are contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238, and 2002-23306. The sensitizing dyes described above may be used alone or two or more of them may be used in combination. In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-Electron Oxidation Product Which Releases One or More Electrons The photothermographic material of the invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). The preferable ranges of these compounds are the same as the preferable ranges described in the quoted specifications.

Formula (1)

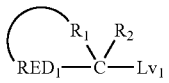

Formula (2)

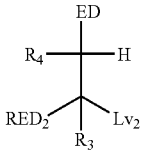

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

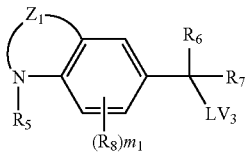

Formula (4)

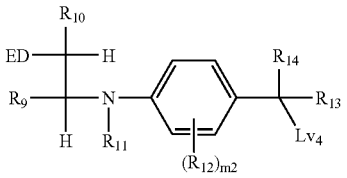

Formula (5)

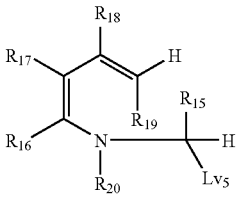

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

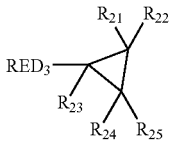

Formula (7)

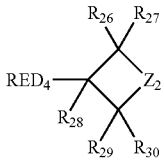

In formulae (6) and (7), $RED_3$ and $RED_4$ each independently represent a reducing group. $R_{21}$ to $R_{30}$ each independently represent a hydrogen atom or a substituent. $Z_2$ represents one selected from $—CR_{111}R_{112}—$, $—NR_{113}—$, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

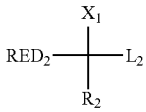

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

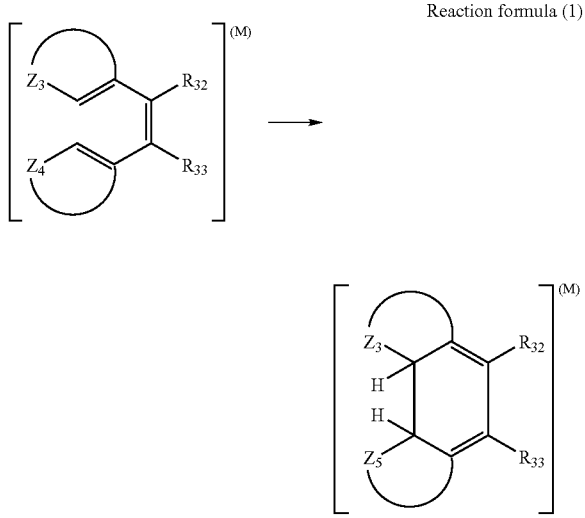

-continued

Formula (9)

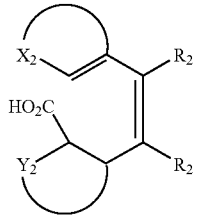

The compound represented by formula (9) is a compound that undergoes a bonding reaction represented by reaction fomula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hydrocarbon group or heterocyclic group with C—C.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group which links $RED_6$ and Y.

Reaction formula (1)

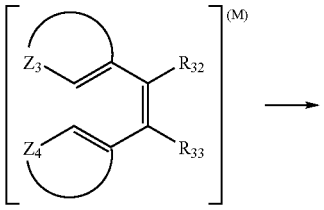

-continued

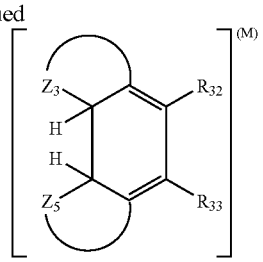

Formula (11)

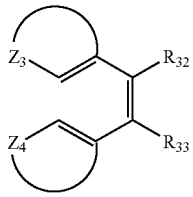

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (—N(Ag)—) (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

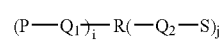

Formula (X)

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably comprises a compound having an adsorptive group to silver halide and a reducing group in a molecule. It is preferred that the compound is represented by the following formula (I).

A-(W)*n*-B Formula (I)

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or a salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (—N(Ag)—) or a heterocyclic group, having an —S— group, a —Se— group, a —Te— group or a =N— group as a partial structure of a heterocycle, and capable to coordinate to a silver ion by a coordinate bond. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (—N(Ag)—) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)

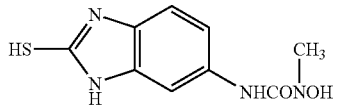

(2)

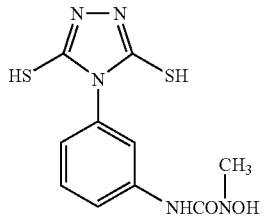

(3)

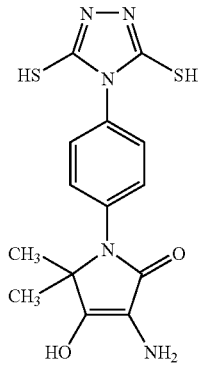

(4)

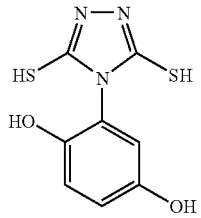

(5)

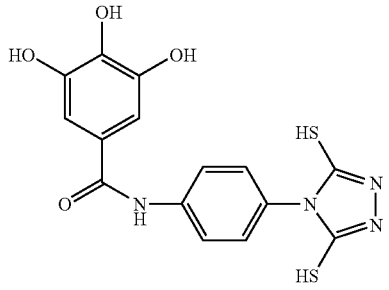

-continued (6)

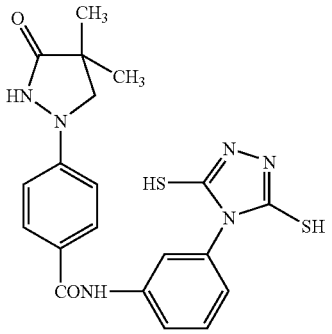

(7)

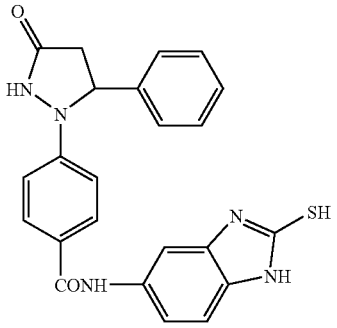

(8)

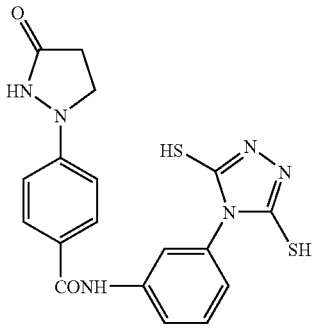

(9)

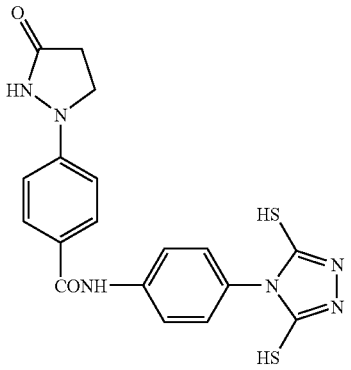

-continued (10)

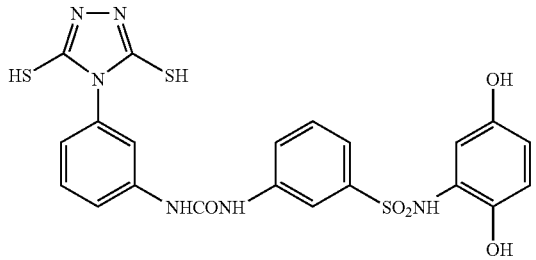

(11)

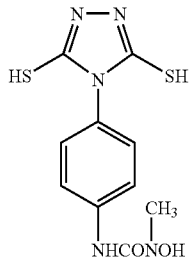

(12)

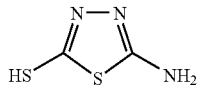

(13)

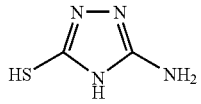

Further, the example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) in the present invention can be used alone, but it is preferred to use two or more of the compounds in combination. When two or more of the compounds are used in combination, those may be added to the same layer or the different layers, whereby adding methods may be different from each other.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of a Plurality of Silver Halides

The photosensitive silver halide emulsion in the photothermographic material used in the invention may be used alone, or two or more of them (for example, those of different average particle sizes, different halogen compositions, of different crystal habits and of different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, most preferably, from 0.07 $g/m^2$ to 0.3 $g/m^2$. The photosensitive silver halide is used in a range of from 0.01 mol to 0.5 mol, preferably, from 0.02 mol to 0.3 mol, and even more preferably from 0.03 mol to 0.2 mol, per 1 mol of the organic silver salt.

13) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, U.S. Pat. No. 6,083,681, and EP No. 1048975.

1) Organic Polyhalogen Compound

Preferable organic polyhalogen compound that is used in the invention is explained specifically below. In the invention, preferred organic polyhalogen compound is the compound expressed by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(=O)—, —SO—, —$SO_2$—, —C(=O)N(R)—, or —$SO_2$N(R)—; more preferably, —C(=O)—, —$SO_2$—, or —C(=O)N(R)—; and particularly preferably, —$SO_2$— or —C(=O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(=O)N(R)—. And, in the case where Q is an aryl group or a heterocyclic group, Y is preferably —$SO_2$—.

In formula (H), the form where the residues, which are obtained by removing a hydrogen atom from the compound, bind to each other (generally called bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinium group, or the like), a polyethyleneoxy group, a hydroxy group, or the like is also preferable.

Specific examples of the compound expressed by formula (H) of the invention are shown below.

H-1

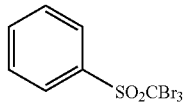

H-2

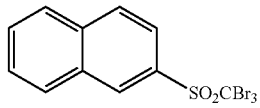

H-3

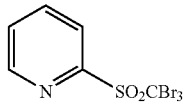

H-4

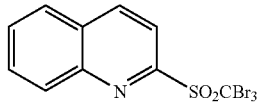

H-5

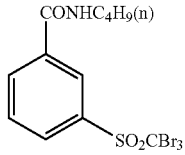

H-6

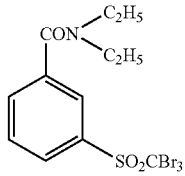

H-7

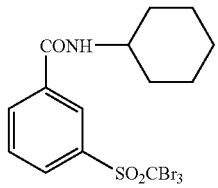

H-8

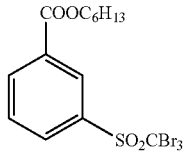

H-9

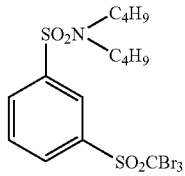

-continued

H-10

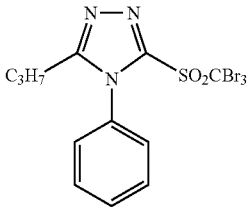

H-11

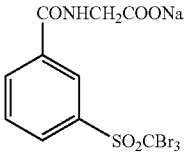

H-12

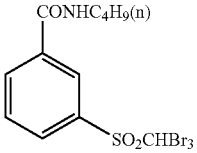

H-13

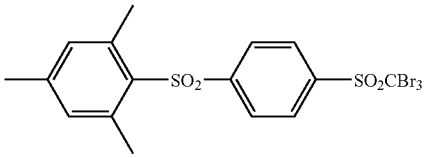

H-14

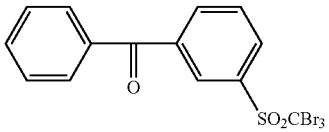

H-15

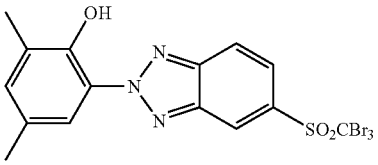

H-16

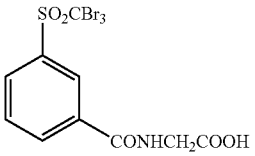

H-17

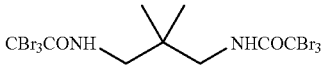

H-18

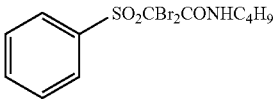

H-19

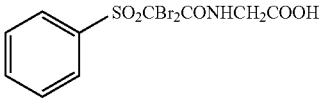

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compound represented by formula (H) of the invention is preferably used in an amount of from $10^{-4}$ mol to 1 mol, more preferably from $10^{-3}$ mol to 0.5 mol, and even more preferably from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, or the like, may be used.

Furthermore, it may be added as a solution having mixed therein other additives such as sensitizing agents, reducing agents, toners, and the like.

In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides, and Thiones

In the present invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, and 2002-303951, and the like are preferred.

2) Toner

In the photothermographic material of the present invention, the addition of a toner is preferred. Descriptions of the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Dyes and Pigments

From the viewpoint of improving color tone, preventing the generation of interference fringes and preventing irradiation on laser exposure, various dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

4) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Other Constitution)

1) Layer Constitution

The photothermographic material of the invention has an image forming layer and various non-photosensitive layers. In general, non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

In the present invention, the outermost layer corresponds to (a) and the non-photosensitive intermediate layer corresponds to (b).

2) Back Layer

The photothermographic material of the present invention preferably comprises a back layer in addition to the outermost layer and the non-photosensitive intermediate layer.

The back layer preferably contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used in an amount as such that the optical density (absorbance) exceeds 0.1 when measured at the desired wavelength. The optical density is preferably in a range of from 0.15 to 2, and more preferably from 0.2 to 1. The addition amount of the dye to obtain optical density in the above range is generally from 0.001 $g/m^2$ to 1 $g/m^2$.

By decoloring the dye in such a manner, the optical density after thermal development can be lowered to 0.1 or lower. Two or more thermal bleaching dyes may be used in combination in a photothermographic material. Similarly, two or more base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-28846, 63-306436, 63-314535, 01-61745, 2001-100363, and the like.

Such coloring matters are generally added in a range of from 0.1 mg/m$^2$ to 1 g/m$^2$, preferably to the back layer which is provided on the side opposite to the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming layer side, or on the backside.

The photothermographic material of the invention is preferably a so-called one-side photosensitive material, which comprises at least one layer of a image forming layer containing silver halide emulsion on one side of the support, and a back layer on the other side.

3) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

4) Surfactant

Concerning the surfactant which can be used in combination, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2003-149766 are preferably used. Especially, the usage of the fluorocarbon surfactants described in JP-A Nos. 2003-57780 and 2003-149766 in an aqueous coating solution is preferred viewed from the standpoint of capacity in static control, stability of the coated surface state and sliding facility. The fluorocarbon surfactant described in JP-A No. 2003-149766 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2003-149766 is greatly effective, and used preferably in a range of from 0.01 mg/m$^2$ to 10 mg/m$^2$, and more preferably, in a range of from 0.1 mg/m$^2$ to 5 mg/m$^2$.

5) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer can be laid on either side of the image forming layer side or the backside, it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

6) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No.

8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for an image forming layer or a back layer is conducted on the support.

7) Other Additives

Furthermore, an antioxidant, a stabilizing agent, a plasticizer, a UV absorbent, or a film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

8) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of mono-sheet type (i.e., a type which can form image on the photothermographic material without using other sheets such as an image-receiving material).

9) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

10) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, and 2001-348546.

(Image Forming Method)

1) Exposure

The photothermographic material of the invention may be subjected to imagewise exposure by any exposure light source. Preferably, the exposure light source is He—Ne laser of red through infrared emission, red laser diode, or $Ar^+$, He—Ne, He—Cd laser of blue through green emission, or blue laser diode. More preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 second to 30 seconds, even more preferably from 5 seconds to 25 seconds, and particularly preferably from 7 second to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C.

Such a process is also described in JP-A No. 54-30032, which allows for passage of moisture and organic solvents included in the photothermographic material out of the system, and also allows for suppressing the change in shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably used for photothermographic materials for use in medical diagnosis, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV A·minute/m$^2$ was executed, judging from the readings of current and voltage on that occasion. The frequency upon this treatment was 9.6 kHz, and the gap clearance between the electrode and dielectric roll was 1.6 mm.

3) Undercoating (1) Preparations of Coating Solution for Undercoat Layer

| Formula (1) (for undercoat layer on the image forming layer side) | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethyleneglycol monononylphenylether (average ethylene oxide number = 8.5) 1% by weight solution | 11.0 g |
| MP-1000 manufactured by Soken Chemical & Engineering Co., Ltd. (PMMA polymer fine particle, mean particle diameter of 0.4 μm) | 0.91 g |
| Distilled water | 931 mL |
| **Formula (2) (for first layer on the backside)** | |
| Styrene-butadiene copolymer latex (solid content of 40% by weight, styrene/butadiene mass ratio = 68/32) | 130.8 g |
| Sodium salt of 2,4-dichloro-6-hydroxy-S-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| **Formula (3) (for second layer on the backside)** | |
| $SnO_2$/SbO (9/1 by mass ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 8.4 mL/$m^2$, and dried at 180° C. for 6 minutes. Thus, an undercoated support was produced.

(Back Layer)

1) Preparation of Coating Solution for Back Layer

<Preparation of Dispersion of Solid Fine Particles (a) of Base Precursor>

2.5 kg of base precursor-1,300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

<Preparation of Solid Fine Particle Dispersion of Dye>

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 37 g of gelatin having an isoelectric point of 6.6 (ABA gelatin, manufactured by Nippi Co., Ltd.), 0.1 g of benzoisothiazolinone, and water to allow gelatin to be dissolved. Additionally, 36 g of the above-mentioned dispersion of the solid fine particles of the dye, 73 g of the above-mentioned dispersion of the solid fine particles (a) of the base precursor, 43 mL of a 3% by weight aqueous solution of sodium polystyrenesulfonate, and 82 g of a 10% by weight liquid of SBR latex (styrene/butadiene/acrylic acid copolymer; mass ratio of the copolymerization of 68.3/28.7/3.0) were admixed to give a coating solution for the antihalation layer in an amount of 773 mL. The pH of the resulting coating solution was 6.3.

2) Preparation of Coating Solution for Back Surface Protective Layer

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved. Additionally, 8.1 mL of a 1 mol/L sodium acetate aqueous solution, 0.93 g of monodispersed fine particles of poly(ethylene glycol dimethacrylate-co-methyl methacrylate) (a mean particle diameter of 7.7 μm, and a standard deviation of particle diameter of 0.3), 5 g of a 10% by weight emulsion of liquid paraffin, 10 g of a 10% by weight emulsion of dipentaerythritol hexaisostearate, 10 mL of a 5% by weight aqueous solution of sodium di(2-ethylhexyl)sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight liquid of ethyl acrylate/acrylic acid copolymer (mass ratio of the copolymerization of 96.4/3.6) latex were admixed. Just prior to the coating, 50 mL of a 4% by weight aqueous solution of N,N-ethylenebis(vinylsulfone acetamide) was admixed to give a coating solution for the back surface protective layer in an amount of 855 mL. The pH of the resulting coating solution was 6.2.

3) Coating of Back Layer

The backside of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

(Image Forming Layer, Intermediate Layer, and Surface Protective Layer)

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid 88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resultant reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Solid Dispersions of Development Accelerator-2 and Color-Tone-Adjusting Agent-1

Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (¼ G sand grinder mill: manufactured by AIMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

11) Preparation of Dispersion of Silver Salt of Benzotriazole

A dispersion of silver salt of benzotriazole was prepared by the method described in the Example 1 of JP-A No. 1-100177.

12) Preparation of SBR Latex Liquid

SBR latex was prepared as follows.

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, an ionic conductance of 4.80 mS/cm (measurement of the ionic conductance performed using a conductivity meter CM-30S manufactured by Toa Electronics Ltd. for the latex stock solution (44% by weight) at 25° C.), and the pH of 8.4.

SBR latexes having a different Tg can be prepared similarly by properly changing the ratio of stylene and butadiene.

2. Preparations of Coating Solution

1) Preparation of Coating Solution for Image Forming Layer

To the dispersion of the silver salt of fatty acid in an amount of 1000 g were serially added water, the pigment-1 dispersion, the organic polyhalogen compound-1 dispersion, the organic polyhalogen compound-2 dispersion, the phthalazine compound-1 solution, the SBR latex (Tg: 17° C.) liquid, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. The mixed emulsion A for coating solution was added thereto, followed by thorough mixing just prior to the coating, which was fed directly to a coating die.

Viscosity of the above-described coating solution for the image forming layer was 40 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 30, 43, 41, 28, and 20 [mPa·s], respectively, at the shearing rate of 0.1, 1, 10, 100, 1000 [1/second].

The amount of zirconium in the coating solution was 0.30 mg per 1 g of silver.

2) Preparations of Coating Solution for Intermediate Layer A

<<Preparation of Coating Solution for Intermediate Layer A-1>>

To 1000 g of poly(vinyl alcohol) PVA-205 (manufactured by Kuraray Co., Ltd.), 163 g of the pigment-1 dispersion, 33 g of a 18.5% by weight aqueous solution of blue dye-1 (manufactured by Nippon Kayaku Co., Ltd.: Kayafect turquoise RN liquid 150), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer A-1 was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

<<Preparations of Coating Solution for Intermediate Layer A-2 to A-5>>

Preparations of the coating solution for the intermediate layer A-2 to A-5 were conducted in a similar manner to the process in the preparation of coating solution for the intermediate layer A-1 except that, in place of poly(vinyl alcohol) PVA-205 and methyl methacrylate/styrene/butyl acrylate/hydroxyethyl methacrylate/acrylic acid copolymer, the binder and the addition amount thereof were changed as described in Table 2 and thereafter a viscosity increasing agent was added.

3) Preparation of Coating Solution for Intermediate Layer B

In 704 mL of water were dissolved 100 g of inert gelatin and 10 mg of benzoisothiazolinone, and thereto were added 146 g of the dispersion of silver salt of benzotriazole, 180 g of a 19% by weight solution of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 35 mL/$m^2$.

4) Preparation of Coating Solution for Outermost Layer

In 800 mL of water were dissolved 100 g of inert gelatin and 10 mg of benzoisothiazolinone, and thereto were added 40 g of a 10% by weight liquid paraffin emulsion, 40 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl) sulfosuccinate, 4 g of poly(methyl methacrylate) fine particles (mean particle diameter of 0.7 μm, volume weighted mean distribution of 30%), and 21 g of poly(methyl methacrylate) fine particles (mean particle diameter of 3.6 μm, volume weighted mean distribution of 60%), and the obtained mixture was mixed.

Viscosity of the coating solution was 19 [mPa·s] which was measured with a B type viscometer at 40° C. (No. 1 rotor, 60 rpm).

The coated thickness of the outermost layer was adjusted to be the amount shown in Table 2 by controlling the flow rate of the coating solution to the coating die.

3. Preparations of Photothermographic Material

1) Preparations of Photothermographic Material-101 to -110

Reverse surface of the back surface was subjected to simultaneous overlaying coating by a slide bead coating method in order of coating solution for the image forming layer, the coating solution for intermediate layer A, the coating solution for intermediate layer B, and the coating solution for the outermost layer, starting from the undercoated face, and thus sample of photothermographic material was produced. In this method, the temperature of the coating solution was adjusted to 31° C. for the image forming layer and the intermediate layer A, to 36° C. for the intermediate layer B, and to 37° C. for the outermost layer.

The combinations of coating solutions of each layer are shown in Table 2.

The coating amount of each compound (g/m$^2$) for the image forming layer is as follows.

| | |
|---|---|
| Organic silver salt | 5.02 |
| Pigment (C. I. Pigment Blue 60) | 0.0324 |
| Organic polyhalogen compound-1 | 0.108 |
| Organic polyhalogen compound-2 | 0.225 |
| Phthalazine compound-1 | 0.161 |
| SBR latex | 8.73 |
| Reducing agent-1 | 0.36 |
| Reducing agent-2 | 0.36 |
| Hydrogen bonding compound-1 | 0.522 |
| Development accelerator-1 | 0.019 |
| Development accelerator-2 | 0.016 |
| Color-tone-adjusting agent-1 | 0.006 |
| Mercapto compound-1 | 0.0018 |
| Mercapto compound-2 | 0.0108 |
| Silver halide (on the basis of Ag content) | 0.09 |

Conditions for coating and drying are as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

TABLE 2

| | Coating Solution for Intermediate Layer A | | | | | | | | | | |
|---|---|---|---|---|---|---|---|---|---|---|---|
| | | Binder | | Viscosity Increasing Agent | | | | | | | |
| Sample No. | Coating Solution No. | Polymer | Addition amount (g/m$^2$) | Polymer | Addition amount (g/m$^2$) | pH of Coating Solution | Mean Thickness (μm) | Variation Coefficient (%) | Mean Thickness of Outermost Layer (μm) | Note |
| 101 | 1 | Polymer A | 0.71 | PVA-205 | 0.89 | 6.5 | 1.6 | 100 | 0.6 | Comparative |
| 102 | 1 | Polymer A | 0.71 | PVA-205 | 0.89 | 6.5 | 1.6 | 100 | 0.4 | Comparative |
| 103 | 2 | Polymer B | 1.36 | PVA-205 | 0.24 | 8.2 | 1.6 | 6 | 0.6 | Comparative |
| 104 | 2 | Polymer B | 1.36 | PVA-205 | 0.24 | 8.2 | 1.6 | 5 | 0.4 | Invention |
| 105 | 2 | Polymer B | 1.36 | PVA-205 | 0.24 | 8.2 | 1.6 | 6 | 0.3 | Invention |
| 106 | 2 | Polymer B | 1.36 | PVA-205 | 0.24 | 8.2 | 1.6 | 5 | 0.2 | Invention |
| 107 | 2 | Polymer B | 1.36 | PVA-205 | 0.24 | 8.2 | 1.6 | 5 | 0.1 | Invention |
| 108 | 3 | Polymer B | 1.36 | PVA-205 | 0.18 | 8.2 | 1.6 | 10 | 0.4 | Invention |
| 109 | 4 | Polymer B | 1.36 | PVA-205 | 0.12 | 8.2 | 1.6 | 30 | 0.4 | Invention |
| 110 | 5 | Polymer B | 1.36 | PVA-205 | 0.06 | 8.2 | 1.6 | 48 | 0.4 | Invention |

Polymer A: Methyl methacrylate/styrene/butyl acrylate/hydroxyethyl methacrylate/acrylic acid coplymer (mass ratio of the copolymerization of 57/8/28/5/2)
Polymer B: Styrene/butadiene/acrylic acid copolymer (P-31)
PVA-205: Poly(vinyl alcohol) (manufactured by Kuraray Co., Ltd.)

Chemical structures of the compounds used in Examples of the invention are shown below.

Spectral sensitizing dye A

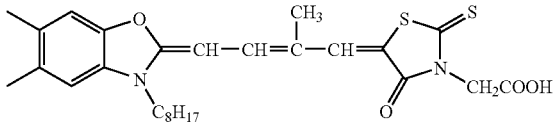

Spectral sensitizing dye B

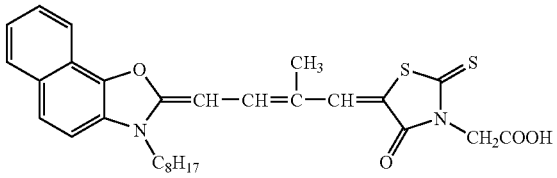

Tellurium sensitizer C

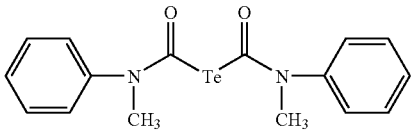

Base precursor-1

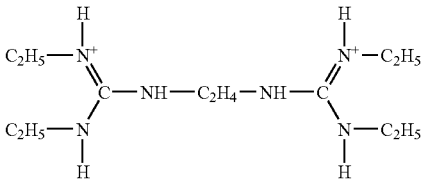

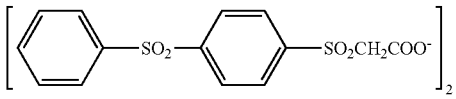

Cyanine dye-1

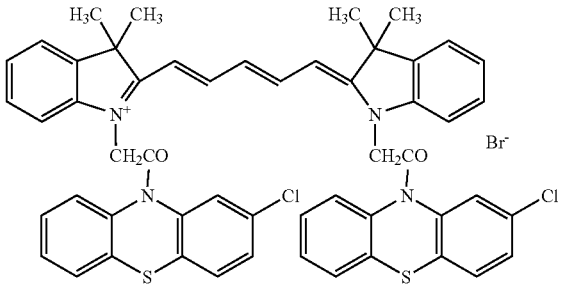

Compound 1 that is one-electron-oxidized to provide a one-electron oxidation product which releases one or more electrons

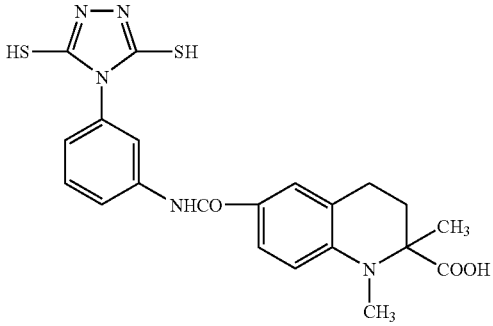

Compound 2 that is one-electron-oxidized to provide a one-electron oxidation product which releases one or more electrons

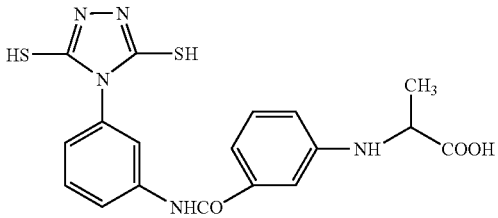

Compound 3 that is one-electron-oxidized to provide a one-electron oxidation product which releases one or more electrons

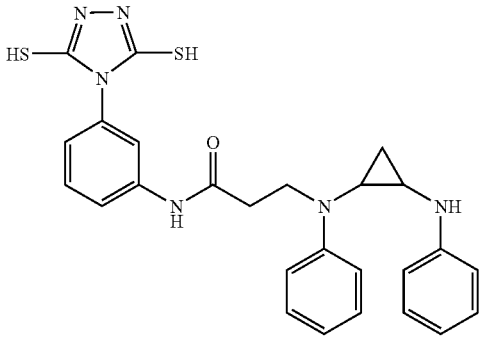

Compound 1 having adsorptive group and reducing group

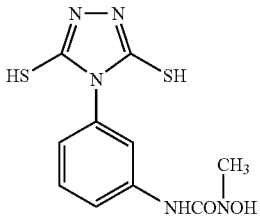

Compound 2 having adsorptive group and reducing group
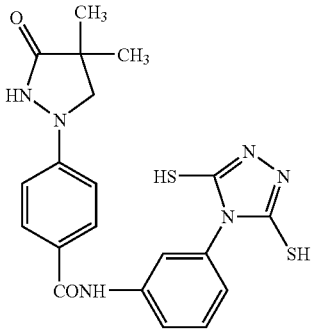
Blue dye-1
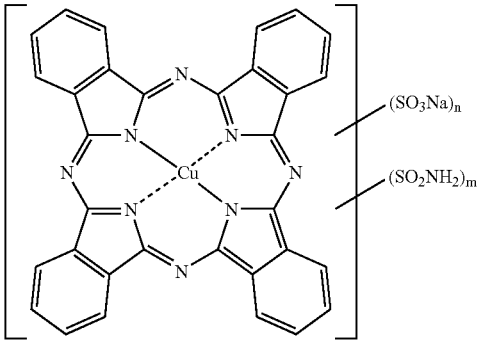
n = 0.5~2.0
m = 0.5~2.5
Reducing agent-1
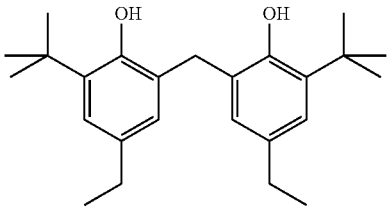
Reducing agent-2
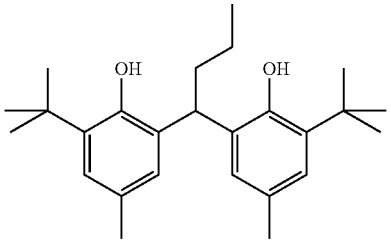
-continued
Hydrogen bonding compound-1
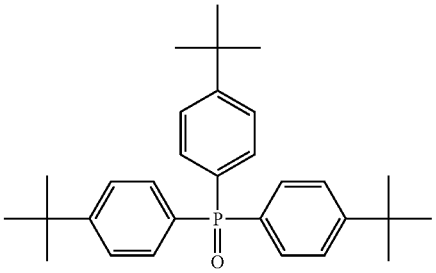
Organic polyhalogen compound-1
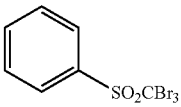
Organic polyhalogen compound-2
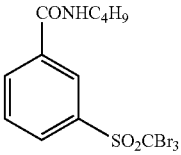
Mercapto compound-1
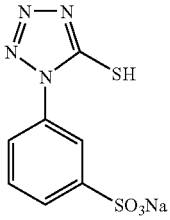
Mercapto compound-2
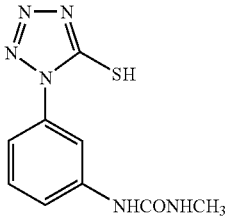
Phthalazine compound-1
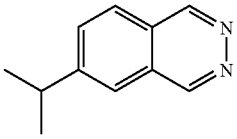
Development accelerator-1
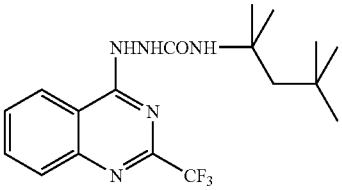

-continued

Development accelerator-2

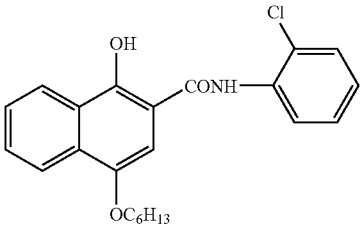

Color-tone-adjusting agent-1

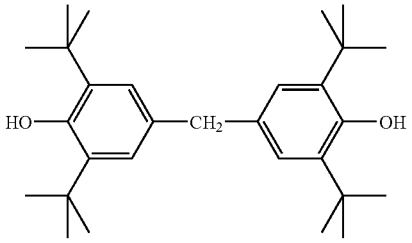

(F-1)

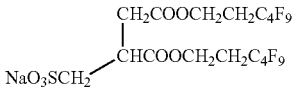

(F-2)

Mixture of

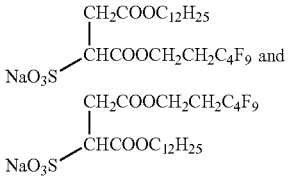

4. Evaluation of Performance

1) Preparation

The obtained sample was cut into a half-cut size (43 cm in length×35 cm in width), and was wrapped with the following packaging material under an environment of 25° C. and 50% RH, and stored for 2 weeks at an ambient temperature.

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation on the obtained image was performed with a densitometer.

3) Terms of Evaluation

<Measurement of Mean Thickness of Intermediate Layer A and Calculating Method of Variation Coefficient of Thickness Distribution of Intermediate Layer A>

The measurement of the thickness of the intermediate layer A and the calculation of variation coefficient of a thickness distribution of the intermediate layer A were performed by the observation of the cross sections of the samples by means of a scanning electron microscope.

The cross sections perpendicular to the sample plane were prepared and observed over a length of 1 mm by a scanning electron microscope to determine a cross section curve C1 for the lower face of the intermediate layer A, namely the intermediate layer A—the image forming layer interface, and a cross section curve C2 for the upper face of the intermediate layer A, namely the intermediate layer A—the intermediate layer B interface. (Note; the cross section curve used herein is defined for the interface between layers in the same way as the definitions according to JIS B 0601 where a cross section curve for the surface texture is determined between a material surface and the surrounding space).

The mean thickness T1 of the intermediate layer A was determined by calculating the length from the center lines of C1 and C2. However, in the case where C2 is not clear depending on the observation conditions, the value calculated from the coating amount of the intermediate layer A can be substituted.

The average roughness Rz expressed by ten point scores was calculated for C1, and thereby the variation coefficient was calculated from by the following equation.

$$\sigma(\%) = Rz/T1 \times 100$$

<Measurement of Mean Thickness of Outermost Layer>

The measurement of a mean thickness of the outermost layer was conducted similar to the measurement of the mean thickness of the intermediate layer A to determine a cross section curve C3 for the lower face of the outermost layer, namely the outermost layer—the intermediate layer B interface, and a cross section curve C4 for the surface of the outermost layer.

The mean thickness T2 of the outermost layer is determined by calculating the length from the center lines of C3 and C4. However, in the case where C3 is not clear depending on the observation conditions, the value calculated from the coating amount of the outermost layer can be substituted.

<Image Unevenness>

Each sample was subjected to uniform exposure to give an optical density of 1.0 and thermal development in the condition described above. Number of coating streaks per unit coated width was counted. The smaller number of streaks indicates the better coating ability.

The standard evaluation criteria are as follows.

◎: No coating streak is seen;

○: coating streak with low density is slightly occurred;

Δ: coating streak with dense density is slightly occurred;

×: coating streak are overall occurred.

<Image Storability>

1) Image Storability Test in Dark Place

This test is an accelerated test for evaluation of image storability.

500 ml of an aqueous solution of sodium chloride was prepared by dissolving 7.5 g of sodium chloride in water. The obtained samples each were subjected to exposure and thermal development. A filter paper absorbed with the aqueous solution of sodium chloride prepared above was overlaid on a portion having an image density of 1.3 in a dark place, and pressed together for 2 seconds. After removing the filter, a half of the sample was stored under the condition of 40° C. and 50RH % over a period of 5 days. Thereafter the remaining half was compared with the stored sample.

The obtained samples were evaluated visually and classified as follows. Because the evaluation results were based on the accelerated test, rank 2 or more is allowable level for practical use.

Rank 5: No density unevenness and no unevenness in surface gloss are seen.

Rank 4: No density unevenness is seen, but slight unevenness in surface gloss is seen.

Rank 3: Slight unevenness in density and slight unevenness in surface gloss are seen.

Rank 2: Slight unevenness in density is seen and unevenness in surface gloss is seen.

Rank 1: Definite unevenness in density is seen and unevenness in surface gloss is seen.

4) Result of Evaluation

The obtained results are shown in Table 3.

Samples of the present invention exhibit excellent performances.

TABLE 3

| Sample No. | Image Unevenness | Image Storability | Note |
|---|---|---|---|
| 101 | X | 1 | Comparative |
| 102 | X | 1 | Comparative |
| 103 | X | 1 | Comparative |
| 104 | ◎ | 5 | Invention |
| 105 | ◎ | 5 | Invention |
| 106 | ○ | 4 | Invention |
| 107 | ○ | 4 | Invention |
| 108 | ○ | 4 | Invention |
| 109 | ○ | 3 | Invention |
| 110 | Δ | 2 | Invention |

Example 2

Preparations of sample Nos. 202 to 210 were conducted in a similar manner to the process in the preparation of Sample No. 109 of Example 1 except that the coating solution-4 for the intermediate layer used for the preparation of Sample No. 109 of Example 1 was changed to the following coating solution. The obtained samples were evaluated similar to Example 1.

<<Preparations of Coating Solution-12 to -20 for Intermediate Layer>>

Preparations of coating solution-12 to -20 for the intermediate layer were conducted in a similar to the process in the preparation of the coating solution-4 for the intermediate layer except that the viscosity increasing agent and the aggregation stabilizer were additionally added thereto and pH of the coating solution was adjusted, as described in Table 4.

TABLE 4

| Coating Solution of Intermediate Layer | | | | | | | | | | | | |
|---|---|---|---|---|---|---|---|---|---|---|---|---|
| | | Binder | | Viscosity Increasing Agent | | Aggregate Stabilizer | | | | | | |
| Sample No. | Coating Solution No. | Polymer | Addition Amount ($g/m^2$) | Polymer | Addition Amount ($g/m^2$) | No. | Addition Amount ($g/m^2$) | pH of Coating Solution | Mean Thickness (μm) | Variation Coefficient (%) | Mean Thickness of Outermost Layer (μm) | Note |
| 109 | 9 | Polymer B | 1.36 | PVA-205 | 0.12 | — | — | 8.2 | 1.6 | 30 | 0.4 | Invention |
| 202 | 12 | Polymer B | 1.36 | PVA-205 | 0.14 | A | 0.03 | 8.2 | 1.6 | 30 | 0.4 | Invention |
| 203 | 13 | Polymer B | 1.36 | PVA-205 | 0.14 | A | 0.03 | 7.5 | 1.6 | 30 | 0.4 | Invention |
| 204 | 14 | Polymer B | 1.36 | PVA-205 | 0.14 | A | 0.03 | 7.2 | 1.6 | 30 | 0.4 | Invention |
| 205 | 15 | Polymer B | 1.36 | PVA-205 | 0.14 | A | 0.03 | 6.2 | 1.6 | 30 | 0.4 | Invention |
| 206 | 16 | Polymer B | 1.36 | PVA-217 | 0.016 | A | 0.06 | 8.2 | 1.6 | 6 | 0.4 | Invention |
| 207 | 17 | Polymer B | 1.36 | PVA-217 | 0.016 | B | 0.06 | 8.2 | 1.6 | 5 | 0.4 | Invention |
| 208 | 18 | Polymer B | 1.36 | PVA-217 | 0.016 | C | 0.06 | 8.2 | 1.6 | 5 | 0.4 | Invention |
| 209 | 19 | Polymer B | 1.36 | 60SH50 | 0.015 | A | 0.08 | 8.2 | 1.6 | 6 | 0.4 | Invention |
| 210 | 20 | Polymer B | 1.36 | 60SH50 | 0.015 | B | 0.08 | 8.2 | 1.6 | 6 | 0.4 | Invention |

Polymer A: Methyl methacrylate/styrene/butyl acrylate/hydroxyethyl methacrylate/acrylic acid copolymer (mass ratio of the copolymerization of 57/8/28/5/2)
Polymer B: Styrene/butadiene/acrylic acid copolymer (P-31)
PVA-205: Poly(vinyl alcohol) (manufactured by Kuraray Co., Ltd.)
PVA-217: Poly(vinyl alcohol) (manufactured by Kuraray Co., Ltd.)
60SH50: Hydroxypropylmethyl cellulose (manufactured by Shin-Etsu Chemical Co., Ltd.)
Aggregation stabilizer A: Modified poly(vinyl alcohol) (MP-203, trade name, manufactured by Kuraray Co., Ltd.)
Aggregation stabilizer B: (Poly(ethylene oxide)/poly(propylene oxide)) type copolymer (PLURONIC L-31, trade name, manufactured by BASF Co., Ltd.)
Aggregation stabilizer C: (Poly(ethylene oxide)/poly(propylene oxide)) type copolymer (PLURONIC F-127, trade name, manufactured by BASF Co., Ltd.)

(Result of Evaluation)

Evaluation was performed similar to Example 1. The obtained results are shown in Table 5.

Samples of the present invention exhibit excellent performances similar to Example 1.

TABLE 5

| Sample No. | Image Unevenness | Image Storability | Note |
|---|---|---|---|
| 109 | ○ | 3 | Invention |
| 202 | ○ | 4 | Invention |
| 203 | ○ | 4 | Invention |
| 204 | ○ | 4 | Invention |
| 205 | ◎ | 4 | Invention |
| 206 | ◎ | 4 | Invention |
| 207 | ◎ | 4 | Invention |
| 208 | ◎ | 4 | Invention |
| 209 | ◎ | 4 | Invention |
| 210 | ◎ | 4 | Invention |

What is claimed is:

1. A photothermographic material comprising: an image forming layer comprising at least a photosensitive silver halide, a non-photosensitive organic silver salt, a reducing agent, and a binder on at least one side of a support; an outermost layer on the same side of the support as the image forming layer; and a non-photosensitive intermediate layer between the outermost layer and the image forming layer, wherein 50% by weight or more of a binder of the non-photosensitive intermediate layer is formed by a hydrophobic polymer latex; the outermost layer has a mean thickness of from 0.1 μm to 0.45 μm; the non-photosensitive intermediate layer further contains poly(vinyl alcohol) derivative as a viscosity-increasing agent, and a concentration of the poly(vinyl alcohol) derivative added to a coating solution of the non-photosensitive intermediate layer is in the range of from 0.05 % by weight to 20 % by weight in the coating solution so that the non-photosensitive intermediate layer has a variation coefficient of a thickness distribution of 50% or less based on a mean thickness of the non-photosensitive intermediate layer wherein the mean thickness and the variation coefficient of the thickness distribution of the non-photosensitive intermediate layer are measured by observation of cross sections of the photothermographic material by means of a scanning electron microscope, and the measurement includes:

preparing cross sections perpendicular to a plane of the photothermographic material;

observing the cross sections over a length of 1 mm by a scanning electron microscope to determine a cross section curve C1 for the lower face of the non-photosensitive intermediate layer and a cross section curve C2 for the upper face of the non-photosensitive intermediate layer;

determining the mean thickness T1 of the non-photosensitive intermediate layer by calculating a length from center lines of C1 and C2, provided that, in the case where C2 is not clear depending on observation conditions, the mean thickness can be calculated from a coating amount of the non-photosensitive intermediate layer;

calculating an average roughness Rz for C1 expressed by ten point scores; and calculating the variation coefficient from the following equation, $\sigma(\%)=Rz/T1\times100$.

2. The photothermographic material according to claim 1, wherein the variation coefficient of a thickness distribution of the non-photosensitive intermediate layer is 30% or less based on the mean thickness of the non-photosensitive intermediate layer.

3. The photothermographic material according to claim 2, wherein the variation coefficient of a thickness distribution of the non-photosensitive intermediate layer is 10% or less based on the mean thickness of the non-photosensitive intermediate layer.

4. The photothermographic material according to claim 1, wherein the mean thickness of the non-photosensitive intermediate layer is from 0.1 μm to 10 μm.

5. The photothermographic material according to claim 4, wherein the mean thickness of the non-photosensitive intermediate layer is from 0.5 μm to 5 μm.

6. The photothermographic material according to claim 1, wherein the mean thickness of the non-photosensitive intermediate layer is from 0.5 μm to 5 μm and the variation coefficient of a thickness distribution thereof is 10% or less based on the mean thickness of the non-photosensitive intermediate layer.

7. The photothermographic material according to claim 6, wherein the mean thickness of the outermost layer is from 0.3 μm to 0.45 μm.

8. The photothermographic material according to claim 1, wherein 50% by weight or more of a binder of the outermost layer is formed by a hydrophilic polymer.

9. The photothermographic material according to claim 8, wherein the hydrophilic polymer is gelatin.

10. The photothermographic material according to claim 1, wherein the outermost layer contains a dispersion of a lubricant.

11. The photothermographic material according to claim 1, wherein 50% by weight or more of the binder of the image forming layer is formed by a hydrophobic polymer latex.

12. The photothermographic material according to claim 1, wherein the non-photosensitive intermediate layer comprises an aggregation stabilizer.

13. The photothermographic material according to claim 12, wherein the aggregation stabilizer is at least one compound selected from the group consisting of an amphoteric surfactant, a nonionic surfactant, and modified polyvinyl alcohols.

14. The photothermographic material according to claim 1, wherein the hydrophobic polymer latex of the non-photosensitive intermediate layer is a copolymerized polymer latex having a monomer component represented by the following formula (M) in a range of from 10% by weight to 70% by weight:

$$CH_2{=}CR^{01}{-}CR^{02}{=}CH_2 \qquad \text{Formula (M)}$$

wherein $R^{01}$ and $R^{02}$ each independently represent one selected from a hydrogen atom, an alkyl group having 1 to 6 carbon atoms, a halogen atom, or a cyano group.

15. The photothermographic material according to claim 14, wherein, in formula (M), both of $R^{01}$ and $R^{02}$ represent a hydrogen atom, or one of $R^{01}$ or $R^{02}$ represents a hydrogen atom and the other represents a methyl group.

16. The photothermographic material according to claim 1, wherein at least one of the non-photosensitive intermediate layer or the outermost layer comprises at least one of a non-photosensitive organic silver salt or a non-photosensitive inorganic silver compound.

17. The photothermographic material according to claim 1, wherein at least one of the non-photosensitive intermediate layer or the outermost layer comprises a non-photosensitive organic silver salt.

18. The photothermographic material according to claim 1, wherein the concentration of the poly(vinyl alcohol) derivative added to the coating solution of the non-photosensitive intermediate layer is in the range of from 0.1% by weight to 10% by weight in the coating solution.

* * * * *